US011085297B1

(12) United States Patent
Warren

(10) Patent No.: US 11,085,297 B1
(45) Date of Patent: Aug. 10, 2021

(54) OPPOSED PISTON ENGINE AND ELEMENTS THEREOF

(71) Applicant: Warren Engine Company, Inc., Alexandria, VA (US)

(72) Inventor: James C. Warren, Alexandria, VA (US)

(73) Assignee: Enginuity Power Systems, Inc, Alexandria, VA (US)

( * ) Notice: Subject to any disclaimer, the term of this patent is extended or adjusted under 35 U.S.C. 154(b) by 70 days.

(21) Appl. No.: 15/442,617

(22) Filed: Feb. 24, 2017

Related U.S. Application Data

(60) Provisional application No. 62/299,154, filed on Feb. 24, 2016.

(51) Int. Cl.

| | |
|---|---|
| ***F01B 7/02*** | (2006.01) |
| ***F01B 7/14*** | (2006.01) |
| ***F02B 75/28*** | (2006.01) |
| ***F02B 75/02*** | (2006.01) |
| ***F02F 1/18*** | (2006.01) |
| ***F02F 3/28*** | (2006.01) |

(52) U.S. Cl.
CPC ..... *F01B 7/14* (2013.01); *F02B 75/02* (2013.01); *F02B 75/28* (2013.01); *F02F 1/186* (2013.01); *F02F 3/28* (2013.01); *F02B 2075/027* (2013.01)

(58) Field of Classification Search
CPC .... F02B 75/02; F02B 75/28; F02B 2075/027; F02B 75/30; F02B 25/08; F02B 75/1896; F02B 75/20; F02B 75/225; F02B 23/0687; F02F 1/186; F02F 3/28; F01B 7/02; F01B 7/14; F01B 7/00
USPC ..... 123/51 A, 51 AA, 51 AC, 51 BC, 306, 123/307, 659, 661, 667, 197.2, 193.1, 123/51 R
See application file for complete search history.

(56) References Cited

U.S. PATENT DOCUMENTS 1,431,188 A * 10/1922 Sinclair ..... F01L 7/026 123/59.1
1,511,338 A * 10/1924 Holderness ..... F02F 1/365 123/193.1
1,644,954 A * 10/1927 Shearer ..... F01B 7/14 123/51 A
1,837,870 A * 12/1931 Johnston ..... F01B 7/14 123/198 DC
1,889,946 A * 12/1932 Cadwell ..... F01B 7/14 123/51 AA (Continued)

FOREIGN PATENT DOCUMENTS

DE 202012005573 * 8/2012 ..... F02B 75/28
FR 750231 A * 8/1933 ..... F01B 7/14
GB 565276 A * 11/1944 ..... F02B 75/28

OTHER PUBLICATIONS

FR 750231 Translation (Year: 1933).*

*Primary Examiner* — George C Jin
*Assistant Examiner* — Teuta B Holbrook
(74) *Attorney, Agent, or Firm* — Capitol Patent & Trademark Law Firm, PLLC

(57) ABSTRACT

A four-stroke opposed piston engine contains a drive train containing two outer crank shaft gears, and two inner synchro gears, wherein the inner synchro gears are twice the diameter of the outer crank shaft gears. Additionally, novel piston faces are presented that when fixed on opposed pistons, create annular cavities that form advantageous combustion chambers when the pistons are at top dead center.

11 Claims, 25 Drawing Sheets

(56) References Cited

U.S. PATENT DOCUMENTS 1,958,957 A * 5/1934 Rakos ..... F01B 7/14 123/51 AA
2,495,978 A * 1/1950 Maxwell ..... F01B 7/14 123/51 R
2,699,156 A * 1/1955 Karow ..... F01B 7/14 123/51 BA
2,858,816 A * 11/1958 Prentice ..... F01B 7/14 123/48 B
4,037,572 A * 7/1977 Franz ..... F01B 7/14 123/51 AA
4,164,915 A * 8/1979 Kulhavy ..... F02B 19/04 123/259
4,244,338 A * 1/1981 Rassey ..... F01B 7/14 123/190.2
4,375,792 A * 3/1983 Barret ..... F01B 7/14 123/197.4
5,042,441 A * 8/1991 Paul ..... F01B 7/14 123/257
5,133,306 A * 7/1992 Honkanen ..... F01B 7/02 123/51 AA
5,758,610 A * 6/1998 Park ..... F02B 33/26 123/51 A
7,559,298 B2 * 7/2009 Cleeves ..... F01L 5/06 123/188.5
8,413,619 B2 * 4/2013 Cleeves ..... F01B 7/14 123/48 B
8,677,950 B2 * 3/2014 Hofbauer ..... F01B 7/08 123/306
8,776,739 B2 * 7/2014 Cleeves ..... F01L 1/047 123/90.16
8,789,499 B2 * 7/2014 Alonso ..... F01B 3/10 123/51 R
9,211,797 B2 * 12/2015 Abani ..... B60L 11/1801
9,309,807 B2 * 4/2016 Burton ..... F01B 7/02
9,482,145 B2 * 11/2016 Hofbauer ..... F02B 17/005
9,708,976 B1 * 7/2017 Warren ..... F02B 75/00
10,161,371 B2 * 12/2018 Johnson ..... F02F 3/24
10,662,893 B1 * 5/2020 Powell ..... F02P 15/02
2004/0221823 A1 * 11/2004 Warren ..... F02B 75/282 123/45 R
2007/0028866 A1 * 2/2007 Lindsay ..... F01L 7/04 123/51 BA
2007/0095309 A1 * 5/2007 Reisser ..... F01B 3/0079 123/53.6
2008/0047530 A1 * 2/2008 Cleeves ..... F02B 25/08 123/51 AA
2008/0115771 A1 * 5/2008 Elsbett ..... F01L 5/06 123/51 BA
2010/0147269 A1 * 6/2010 Flowers ..... F01L 5/06 123/51 R
2010/0218744 A1 * 9/2010 Simon ..... F02B 75/282 123/48 B
2011/0094470 A1 * 4/2011 Augot ..... F02B 23/0672 123/193.4
2011/0162621 A1 * 7/2011 Xu ..... F02B 23/104 123/305
2011/0271932 A1 * 11/2011 Fuqua ..... F01B 7/02 123/301
2012/0031379 A1 * 2/2012 Zhou ..... F01B 9/042 123/51 R
2012/0055451 A1 * 3/2012 Jorda ..... F02B 75/282 123/51 R
2012/0073541 A1 * 3/2012 Fuqua ..... F01B 7/02 123/301
2012/0085305 A1 * 4/2012 Cleeves ..... F01L 1/22 123/90.26
2013/0036903 A1 * 2/2013 Daniels ..... F02B 75/282 92/172
2016/0175874 A1 * 6/2016 Beck ..... B01J 13/0095 239/13
2016/0237945 A1 * 8/2016 Jeffries ..... F02B 23/08
2017/0030262 A1 * 2/2017 Venugopal ..... F02B 23/0621
2017/0122199 A1 * 5/2017 Andersson ..... F02D 41/0087
2017/0254261 A1 * 9/2017 Morton ..... F02B 75/28
2017/0335752 A1 * 11/2017 Morton ..... F02B 25/04

* cited by examiner

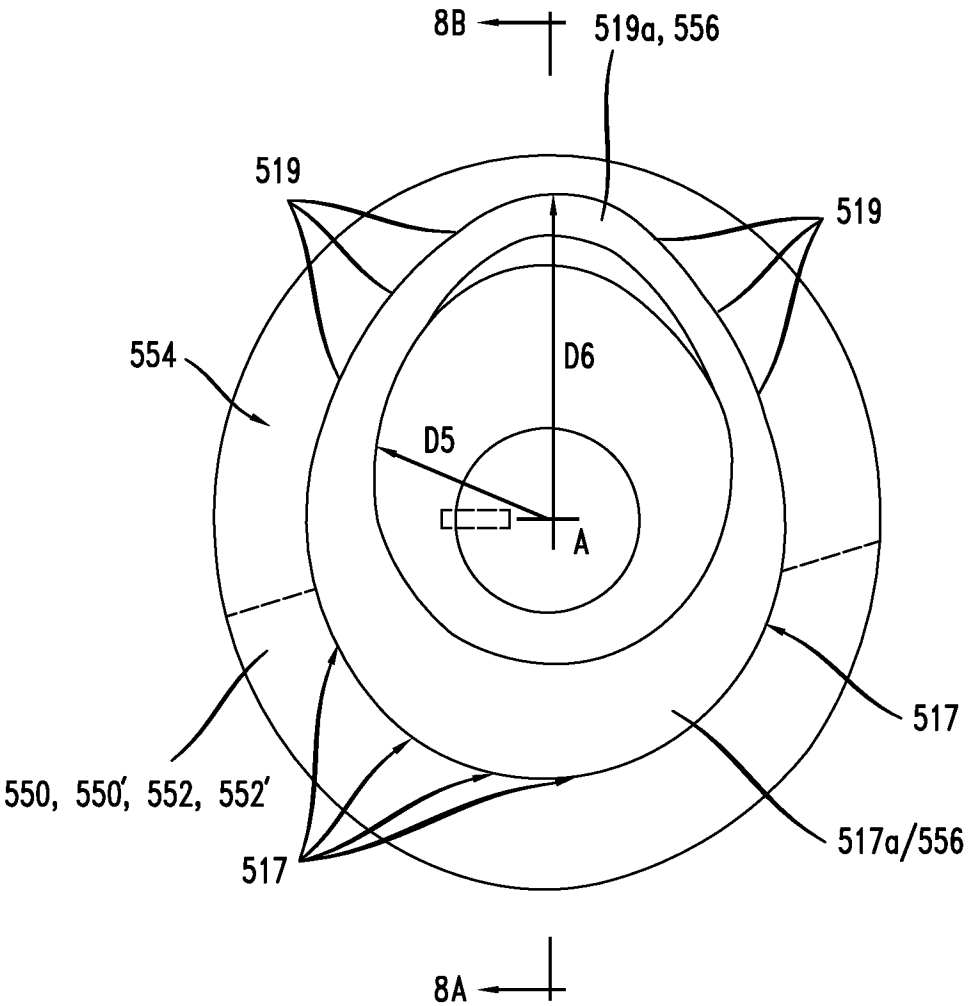
Replacement FIG. 8A
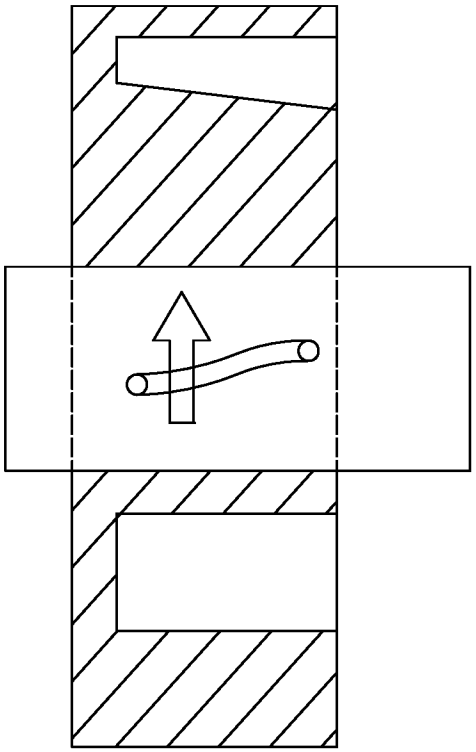
Replacement FIG. 8B

OPPOSED PISTON ENGINE AND ELEMENTS THEREOF

CROSS-REFERENCE TO RELATED APPLICATIONS

The present application claims the benefit of U.S. Provisional Application Ser. No. 62/299,154 having a filing date of Feb. 24, 2016, the teachings of which are herein incorporated by reference in its entirety.

BACKGROUND OF THE INVENTION

An ongoing challenge is to improve the combustion efficiency of opposed-piston engines, thereby enhancing the performance of four-stroke opposed-piston engines. In particular, with certain piston faces, some combustion residue may accumulate if the combustion mixture is not optimally combusted. It is believed that optimum performance of the engine may be affected because of uneven combustion burn, for example.

Another challenge is to reduce the size and complexity of the engine. If certain efficiencies can be built into the incorporation of different parts such as the gear train connected to the crank(s) in the engine, then certain parts may be removed and the size and weight of the overall engine may be reduced.

These and other concerns are addressed by the structural advantages as discussed below.

SUMMARY OF THE INVENTION

A four-stroke opposed piston engine contains: a first cylinder containing a first piston and a second piston opposing the first piston; a second cylinder containing a third piston and a fourth piston opposing the third piston; a first piston face contained on the first piston, and, a second piston face contained on the second piston, the first and second pistons each containing respective first annular regions, wherein the first annular regions define a first combustion chamber when the first and second pistons are at top dead center. A third piston face is contained on the third piston, and, a fourth piston face is contained on the fourth piston, the third and fourth pistons each containing respective second annular regions, the second annular regions defining a second combustion chamber when the third and fourth pistons are at top dead center; a first crank shaft operably communicating with the first and third pistons; and a second crank shaft operably communicating with the second and fourth pistons.

In yet another aspect of the present invention, a four-stroke opposed piston engine contains: a first cylinder containing a first piston and a second piston opposing the first piston; a second cylinder containing a third piston and a fourth piston opposing the third piston; a first crank shaft operably communicating with the first and third pistons; a second crank shaft operably communicating with the second and fourth pistons; and a drive train containing a first crank shaft gear connected to the first crank shaft, a second crank shaft gear connected to the second crank shaft gear, a first synchro gear rotatably communicating with the first crank shaft gear, and a second synchro gear rotatably communicating with the second crank shaft gear and the first synchro gear. Importantly, the first and second crank shaft gears are equal in diameter and the first and second synchro gears equal in diameter and twice the diameter of the first and second crank shaft gears.

Stated another way, the four-stroke opposed piston engine contains: a first cylinder containing a first piston, and, a second piston opposing the first piston; a second cylinder containing a third piston, and, a fourth piston opposing the third piston; a first crank shaft operably communicating with the first and third pistons; a second crank shaft operably communicating with the second and fourth pistons; and a drive train containing a first driver operably communicating with the first crank shaft, a second driver operably communicating with the second crank shaft, a third driver operably communicating with the first driver, and, a fourth driver communicating with the second driver, wherein the third and fourth drivers each have a diameter twice that of the first and second drivers. As stated above, the drivers may correspond to the four-gear driver described above and elsewhere in this application. Furthermore, the drivers may, for example only, constitute a belt-driven pulley system wherein each of the four drivers characterized above constitutes a pulley-driven system. In each of the embodiments, the drivers function and operably communicate with respective valve assemblies as described herein, without the need for reducing apparatus.

BRIEF DESCRIPTION OF THE DRAWINGS

FIG. 8A is a view of an exemplary cam ring, in accordance with an exemplary embodiment of the present invention.

FIG. 8B is a side cross-sectional view of the cam ring of FIG. 8A.

DETAILED DESCRIPTION OF THE INVENTION

Figure 1:
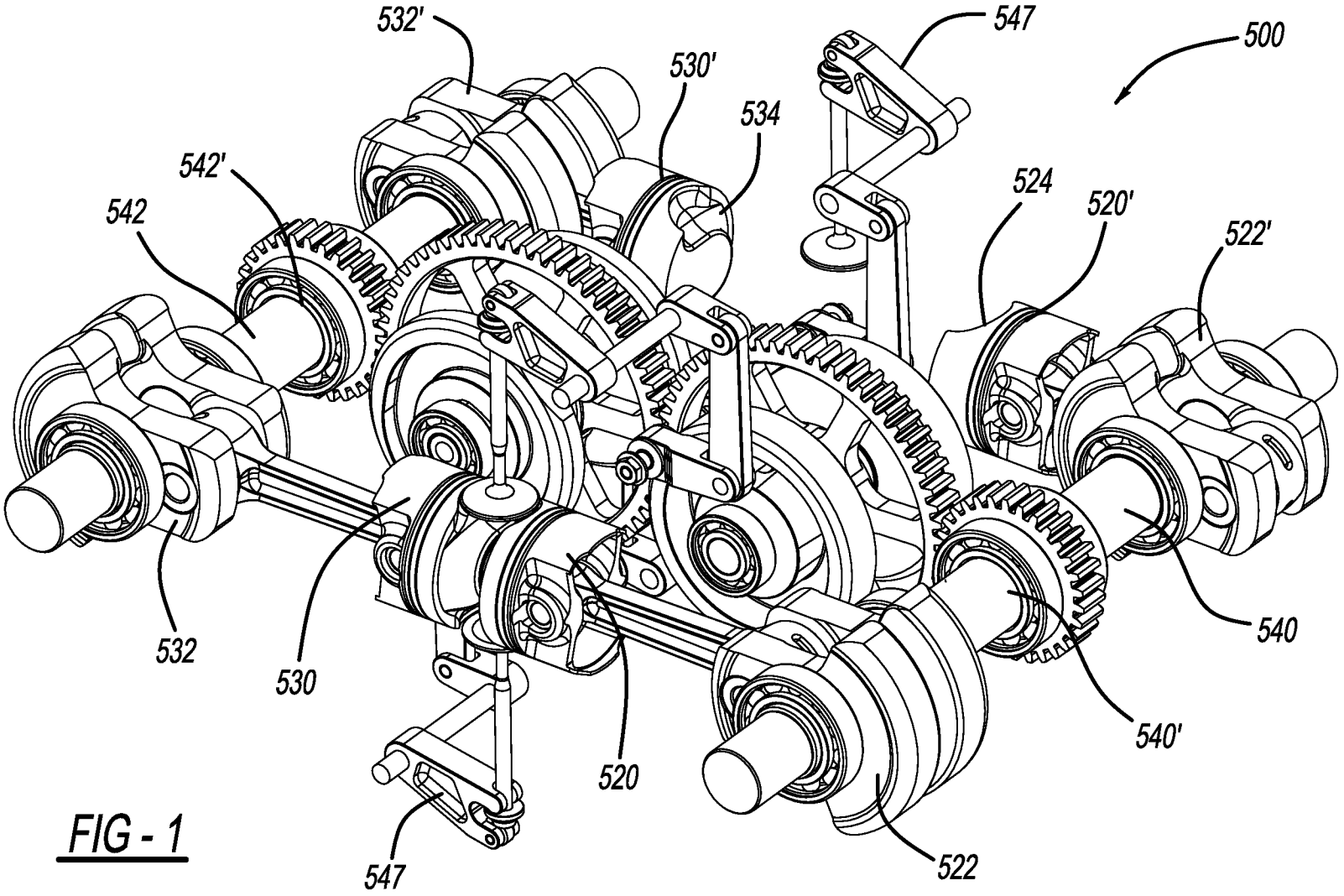
FIG. 1 is a perspective view of an exemplary embodiment of the present invention, showing internal structure of an exemplary engine and the advantageous sizing of the gears driving the valve mechanism.
Figure 2:
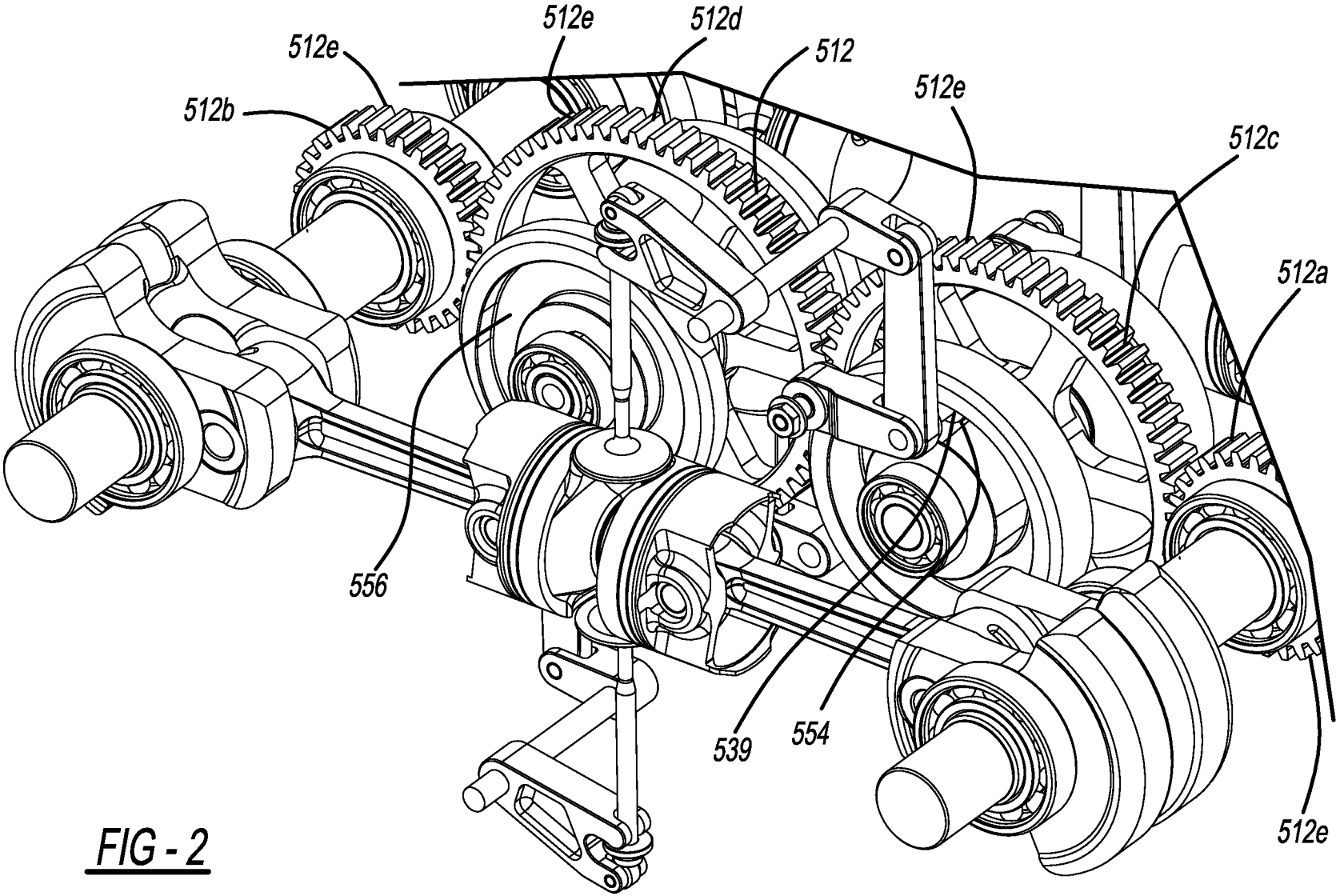
FIG. 2 is a second perspective view of the exemplary embodiment of FIG. 1.

The novel aspects of the present invention are presented below. U.S. Pat. Nos. 7,004,120 and 7,779,795, and U.S. patent application Ser. No. 13/633,097 are related to the present invention, the teachings of which are herein incorporated by reference in their entireties.

Referring to FIGS. 1-7, an opposed piston engine 500 contains an engine housing 505 containing a first cylinder 510 and a second cylinder 510'. A first pair of opposed pistons 520 and 530 are housed within the first cylinder 510. A second pair of opposed pistons 520' and 530' are housed within the second cylinder 510'. Although discussion is directed to the first cylinder 510 containing pistons 520 and 530, the same discussion is applicable with regard to second cylinder 510' and opposed pistons 520' and 530'.

Referring to FIGS. 1-5, opposed pistons 520 and 530 are connected via respective connecting rods 522 and 532 to respective crank shafts 540 and 542 mounted in engine housing 505 as described in U.S. Pat. No. 7,004,120. Pistons 520 and 530 reciprocate within cylinder 510 to rotate the crank shafts, in a manner known in the art. Each associated crank shaft and/or connecting rod is configured to aid in providing a predetermined stroke length to its associated piston residing within the cylinder. The opposed first and second pistons 520 and 530 may be of a relatively standard design, and may have predetermined lengths and predetermined diameters.

In one embodiment, the stroke length of each of pistons 520 and 530 is about 3 inches. Thus, the total difference between the spacing of the pistons at closest approach to each other (i.e., at "top dead center") may range from 0 inches to 0.25 inches, and more preferably from about 0.05 inches to 0.2 inches, and the maximum spacing of the pistons during the engine cycle (i.e., at "bottom dead center") is about 4-7 inches, and more preferably about 6 inches. As will be apparent to one of ordinary skill in the art, these distances may be altered depending on specific design criteria.

If desired, the piston lengths may be adjusted (to substantially equal lengths) for controlling spacing between the piston faces, thereby providing a means for adjusting the compression ratio and generally providing a predetermined degree of compression for heating intake air to facilitate combustion of a fuel injected or otherwise inserted into the combustion chamber. The piston lengths are geometrically determined in accordance with the piston stroke length and the lengths of apertures (described below) formed in the cylinders through which flow exhaust gases and air for combustion. In one embodiment, each piston cap 524 and 534 is formed from a sandwich of two sheets of carbon fiber with a ceramic center.

In accordance with the present invention, the piston caps 524 and 534 which are exposed to the combustion event are formed so that when the two piston caps 524 and 534 meet in the center of the cylinder 510 they preferably form a somewhat toroidal, hour-glass-shaped, or otherwise-shaped cavity as the combustion chamber 521, as shown in FIGS. 22-26. Only the ceramic cores of the piston caps 524 and 534 actually come into contact with the stationary cylinder wall. The toroidal-shaped faces of FIG. 22 have on average 5.558 square inches in annular surface area. The half dome-faced pistons of FIG. 23 have on average 3.792 square inches in annular surface area. The flat topped-faced pistons of FIG. 24 have on average 3.936 square inches in annular surface area. The full domed-faced pistons of FIG. 25 have on average 1.403 square inches in annular surface area. The radius domed-faced pistons of FIG. 26 have on average 2.466 square inches in annular surface area. It will be appreciated that the total annular space of each piston face, when combined with the opposed piston face of the same type, creates a combustion chamber defined by twice the annular surface area of the respective piston face. It will further be appreciated that the combustion chamber compression is increased as the respective annular surface area is decreased. When determining the desired combustion chamber pressure depending on the specific application, the piston face choice is therefore important as it will determine the efficiency of combustion in the combustion chamber formed by the respective two opposed pistons.

Each piston should have a length from the piston fire ring to the cap suitable for keeping the piston rings out of the cylinder opening(s) 510*a*. The piston caps 524 and 534 each have a diameter roughly equal to the interior of the associated cylinder, and may be made of carbon fiber, ceramic, and/or any other suitable material to aid in minimizing thermal inefficiencies during engine operation.

In an embodiment utilizing a delivery conductor and ground conductor for spark generation (as described in U.S. Pat. No. 7,448,352, herein incorporated by reference in its entirety), the face of each piston may also include a slot(s) or groove(s) (not shown) formed therein and configured for providing a clearance between the piston face and the delivery and ground conductors, as the pistons approach each other within the cylinder.

Figure 21:
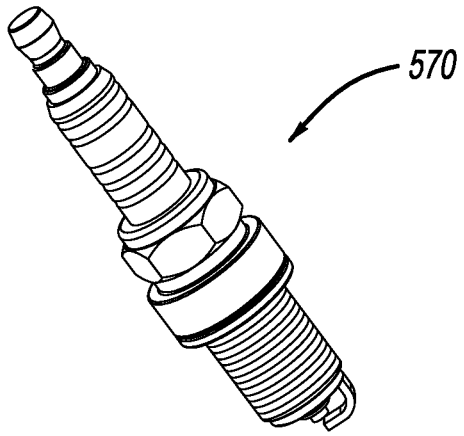
FIG. 21 is a view of an elongated spark plug, used in accordance with the present invention.
Figure 22:
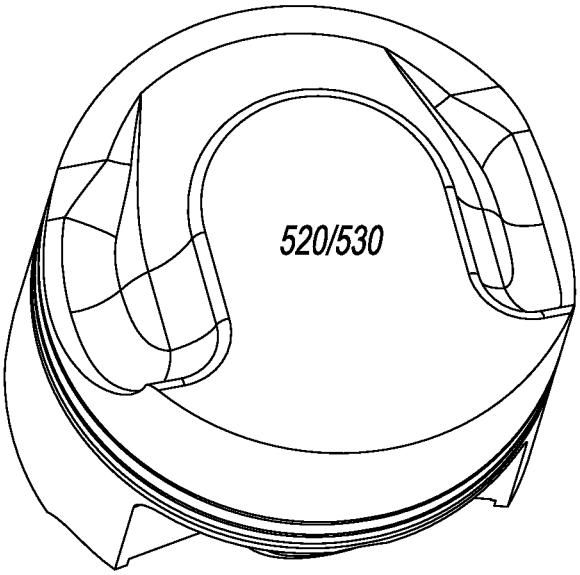
FIG. 22 is a view of a plurality of exemplary toroidal-faced pistons.
Figure 23:
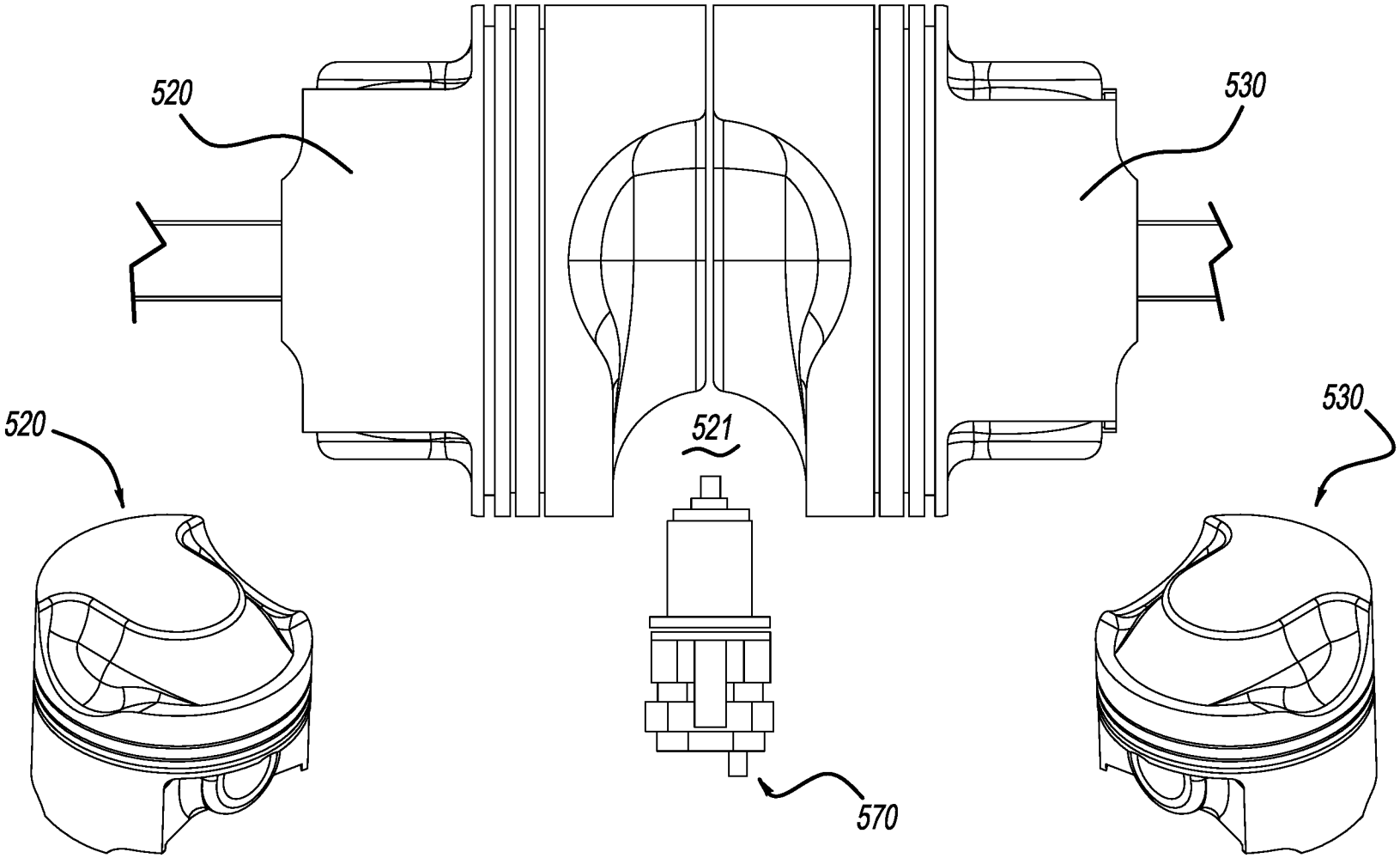
FIG. 23 is a view of opposed half dome-faced pistons, in accordance with the present invention.
Figure 24:
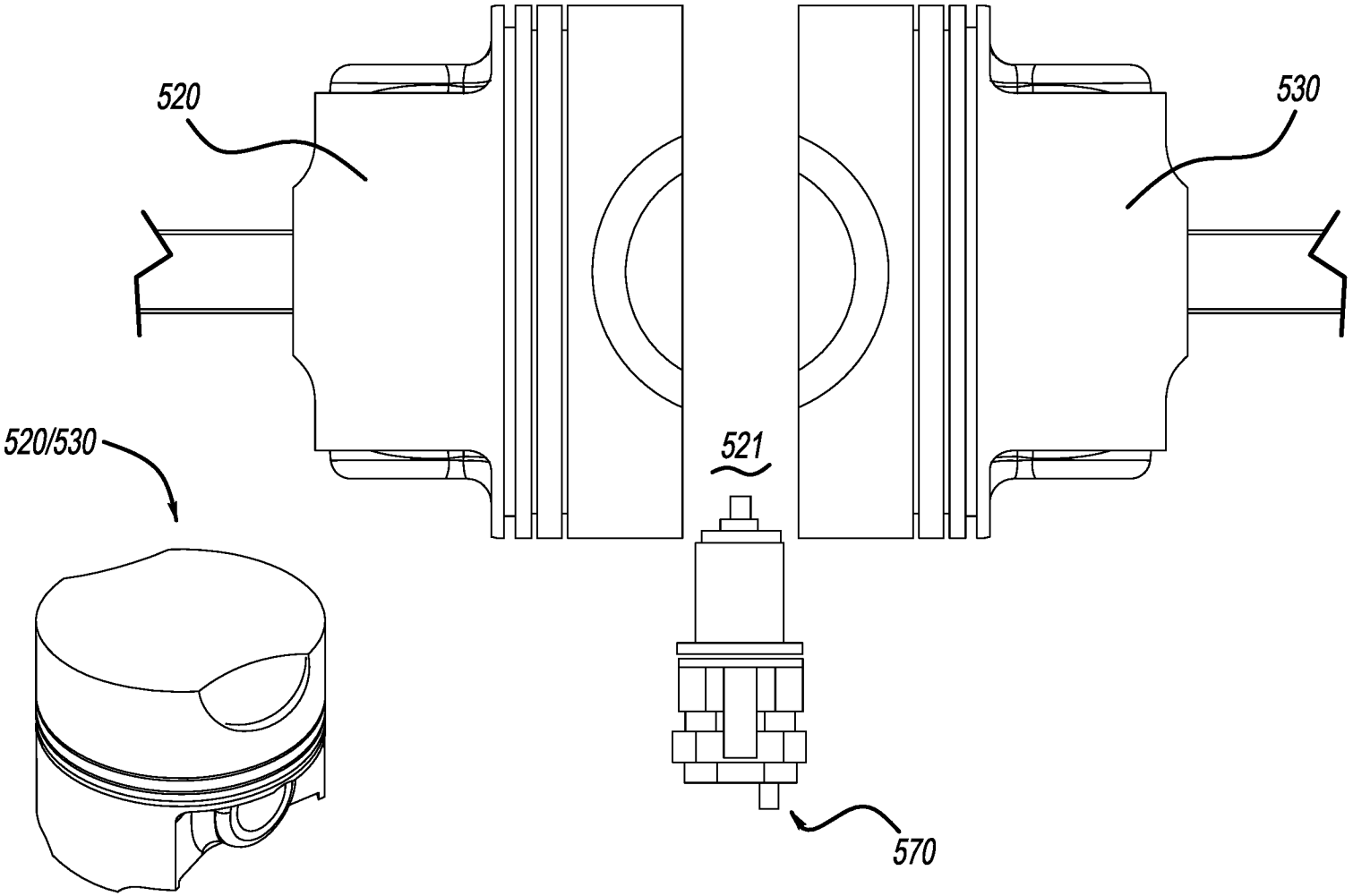
FIG. 24 is a view of opposed flat topped-faced pistons, in accordance with the present invention.
Figure 25:
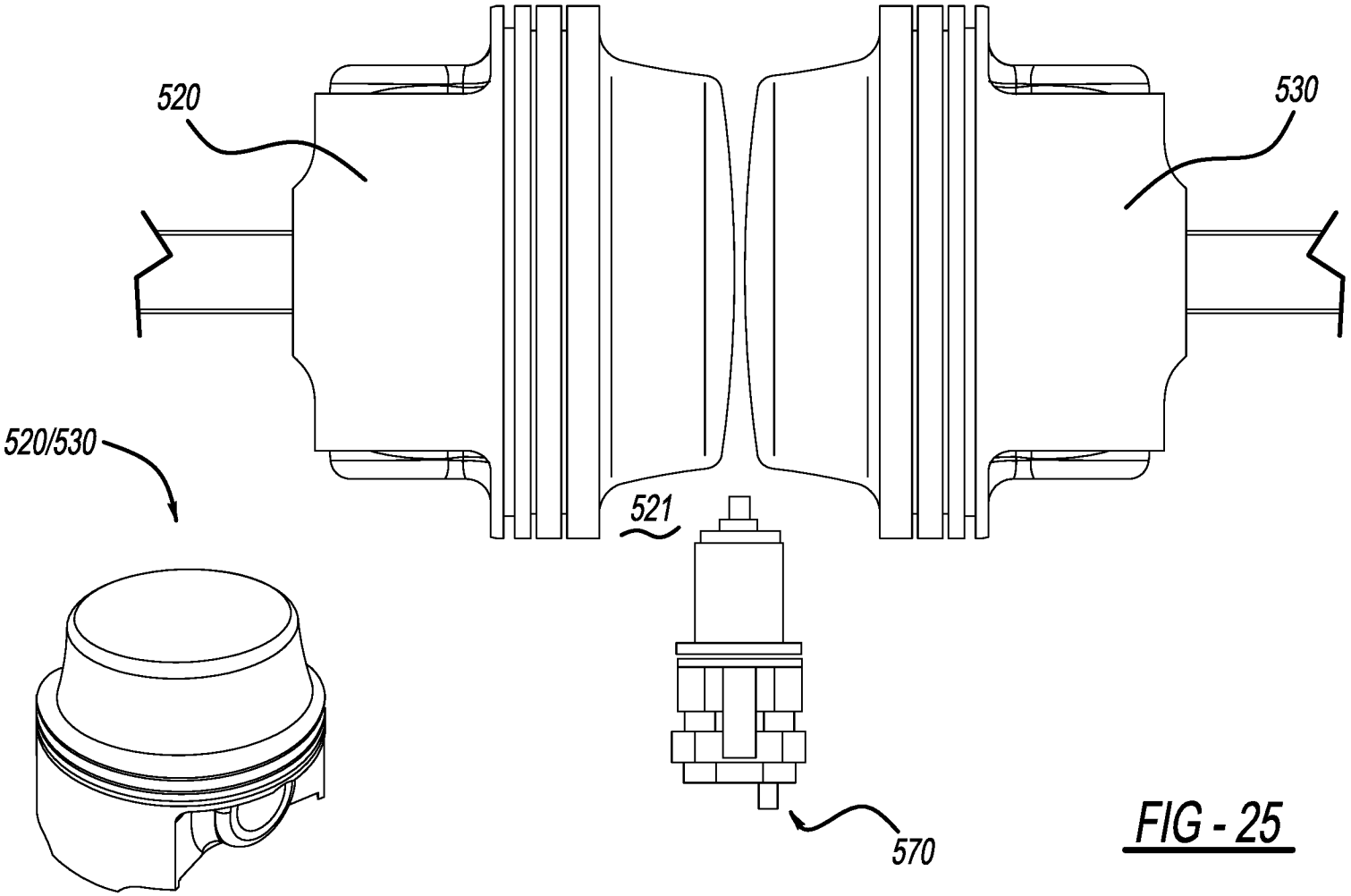
FIG. 25 is a view of opposed full dome-faced pistons, in accordance with the present invention.
Figure 26:
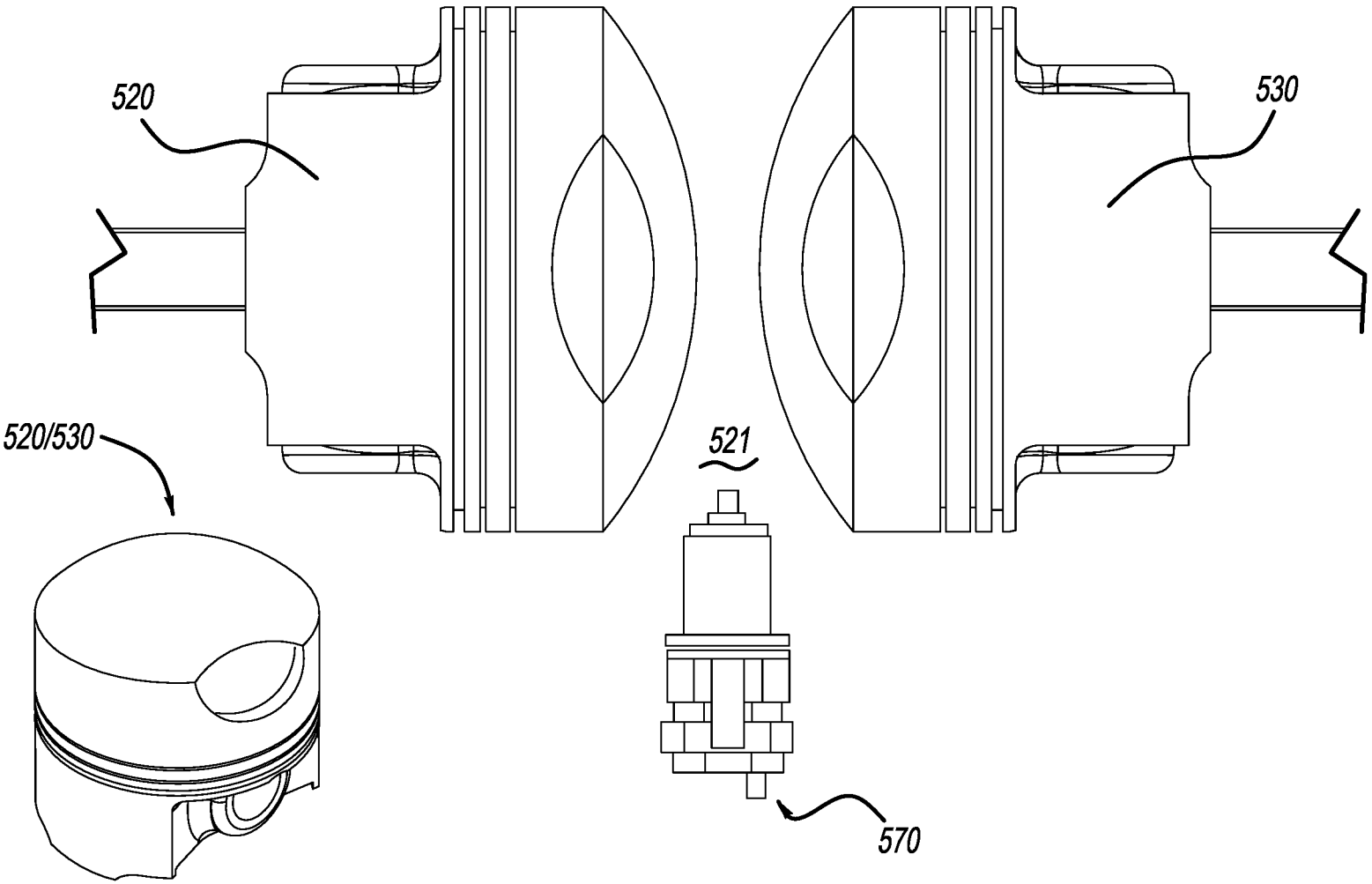
FIG. 26 is a view of opposed radius dome-faced pistons, in accordance with the present invention.

Alternatively, and as shown in FIGS. 6, 11A, 13, 16, and 20, the combustion mixture may be ignited by a spark plug, or by two spark plugs. As shown in FIG. 21, an elongated spark plug may be used to ensure that the spark ignites the combustion mixture in the center of the combustion chamber. Stated another way, positioning the spark at the center of the combustion chamber enhances the combustion efficiency of certain chambers as defined by the piston faces of FIGS. 22-26. Gear train 512 as shown in FIGS. 1-5, for example, may be positioned between the two pairs of opposed pistons 520, 530 and 520', 530'. Alternatively, although not shown, gear train 512 may be juxtaposed exterior of either one of the pair of opposed pistons, while utilizing valve assemblies accommodating that specific orientation. Gear train contains a first gear 512*a* fixed to the first crank shaft 540 about a medial portion 540' thereof, and further contains a second gear 512*b* fixed to the second crank shaft 542 about a medial portion 542' thereof. The gear train 512 further contains a third gear 512*c* with teeth enmeshed with the teeth of first gear 512*a*, and, a fourth gear 512*d* with teeth enmeshed with the teeth of second gear 512*b*. The teeth of third and fourth gears 512*c* and 512*d* are also enmeshed with each other, whereby the movement of any of gears 512*a*-512*d* causes a consequential movement of the remaining gears as shown in the Figures. In accordance with one embodiment of the present invention, the diameter d2 of the third and fourth gears 512*c* and 512*d* is twice the diameter d1 of first and second gears 512*a* and 512*b*, thereby resulting in a two to one ratio with regard to size of the inner or synchro gears 512*c* and 512*d* and the outer or crank shaft gears 512*a* and 512*b*. It will be appreciated that gears 512*a*-512*d* exemplify one drive mechanism, and that the drive mechanism 512 of the engine 500 may also be represented by a drive belts or drive chains, with the same size ratio between the respective driving elements of the belt or chain-driven drive mechanism.

Accordingly, referring to FIGS. 1-5 for example only, the present invention may alternately be described as a four-stroke opposed piston engine 500 containing a first cylinder 510 containing a first piston 520, and, a second piston 530 opposing the first piston 520; a second cylinder 510' containing a third piston 520', and, a fourth piston 530' opposing the third piston 520'; a first crank shaft 540 operably communicating with the first and third pistons 520/520'; a second crank shaft 542 operably communicating with the second and fourth pistons 530/530'; and a drive train 512 comprising a first driver 512*a* operably communicating with the first crank shaft 540, a second driver 512*b* operably communicating with the second crank shaft 542, a third driver 512*c* operably communicating with the first driver 512*a*, and, a fourth driver 512*d* communicating with the second driver 512*b*, the third and fourth drivers each having a diameter twice that of the first and second drivers. It will be appreciated that the benefit of mitigating the need for reducing apparatus extends to other drivers besides the exemplary gear train 512 described herein.

In further accordance with the present invention, and in one embodiment of the present invention, the drive mechanism or gear train 512 converts rotational motion of the crank shafts to rotational motion of a first and second pair of cam discs 550, 550', 552, and 552'. Accordingly, the first pair of cam discs 550 and 550' are each rotationally and coaxially fixed and mounted to the exterior of the third gear 512*c*, such that the gear 512*c* and the associated pair of cam discs 550 and 552 all rotate at the same speed. In one embodiment, these cam discs 550 and 552 operate the inlet valves for each cylinder. In the same way, the second pair of cam discs 550' and 552' are each rotationally and coaxially fixed and mounted to the exterior of the fourth gear 512*d*, such that the gear 512*d* and the associated cam discs 550' and 552' all rotate at the same speed. In the same embodiment, these cam discs 550' and 552' operate the exhaust valves for each cylinder.

Figure 18:
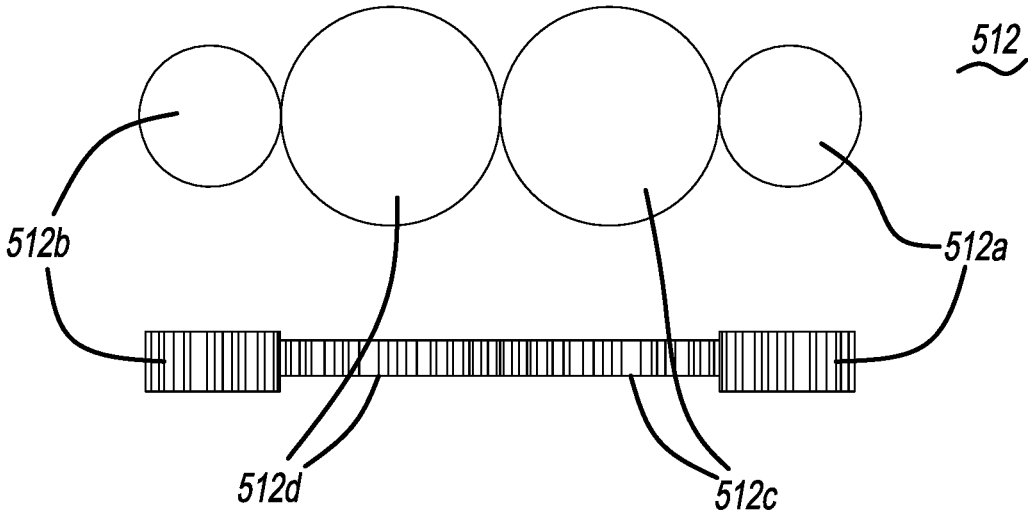
FIG. 18 is a schematic view of the 2:1 ratio of synchro gear to the crank shaft gear, alongside a top view of the gear drive train, in accordance with the present invention.
Figure 19:
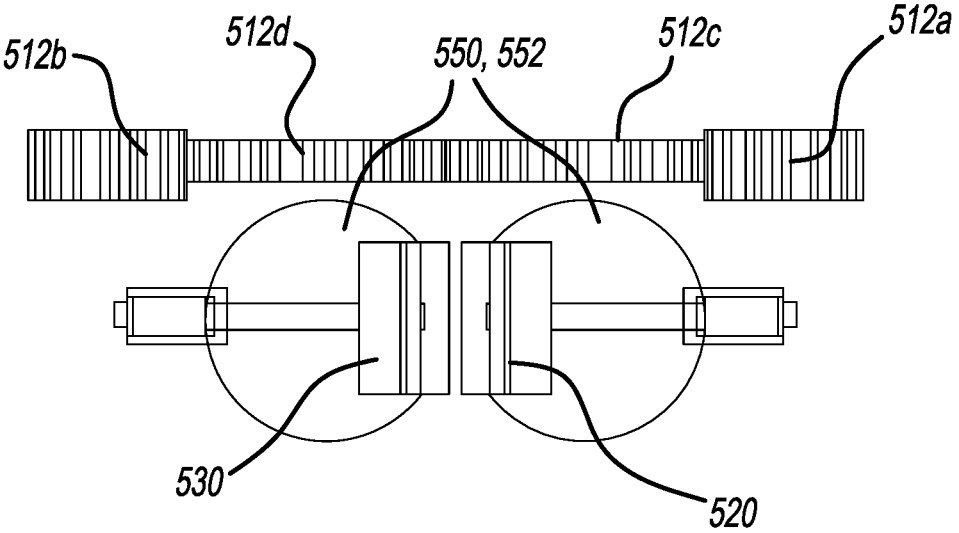
FIG. 19 is a schematic view of the opposed pistons, alongside a top view of the gear drive train, in accordance with the present invention.
Figure 20:
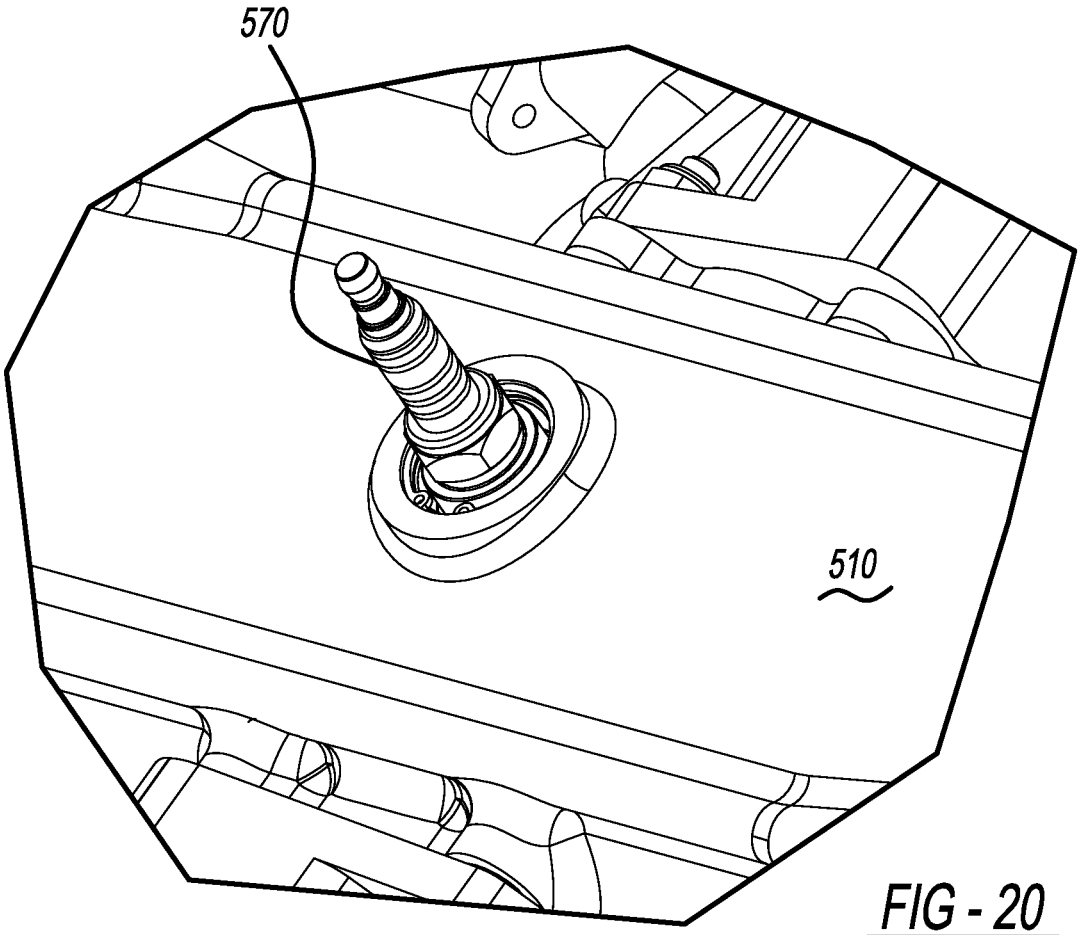
FIG. 20 is a perspective view of an exemplary cylinder having two ports for two respective spark plugs.

FIGS. 18 and 19 show a side view and a plan view of the gear train 512. Referring to FIGS. 18 and 19, in this particular embodiment, gears 512*a*, 512*b* connected to crank shafts 542, 540 (not shown in FIGS. 18 and 19) respectively, rotate at crank shaft speed but are reduced in size to serve as reducing gears. Thus, the rotational speeds of the gears 512*c* and 512*d* (and the rotational speeds of the cam discs 550, 552, 550', and 552' to which they are connected) are reduced to one half of the crank shaft speed. As a result of the 2:1 ratio of the inner gears (512*c*, 512*d*) to the outer gears (512*a*, 512*b*) of the gear train 512, there is no need for additional reducing gears to drive the valve assembly. As such, the weight and complexity of the present four-stroke opposed piston engines are notably improved, i.e. the weight is reduced, and the complexity is also reduced.

Various elements of the vehicle and/or engine systems (for example, an oil pump or coolant circulation pump) may be operatively coupled to and powered by the gear train 512, via the gears in the gear train 512 or via shafts and additional gears operatively coupled to the gear train 512 (not shown).

Referring again to FIGS. 1-9, the cam discs 550, 552, 550', and 552', are incorporated into the engine to actuate associated valve assemblies 560, 562, 564, and 566 (described below) which open and close to permit a flow of air to (and exhaust gases from) each cylinder combustion chamber 521 during operation of the engine. The cam discs 550, 552, 550', and 552' are mounted on the gears 512*c* and 512*d*, respectively, so as to be rotatable along with the gears 512*c* and 512*d*, and the elements are positioned so as to engage actuatable portions of the valve assemblies 560, 562, 564, 566 during cam rotation.

Referring to FIG. 8, in one embodiment, each of camming elements or discs 550, 552, 550', and 552' includes one or more base portions 517 and one or more projecting portions 519 that project radially outwardly, the projection portions 519 contiguously connected to the base portions 517. Each base portion 517 defines a cam profile or surface 517*a*, 556 engageable with an actuatable portion of an associated valve assembly to produce a first state of the valve assembly. Each projecting portion 519 defines a cam profile or surface 519*a*, 556 engageable with the actuatable portion of the valve assembly to produce an associated alternative state of the valve assembly.

Figure 14:
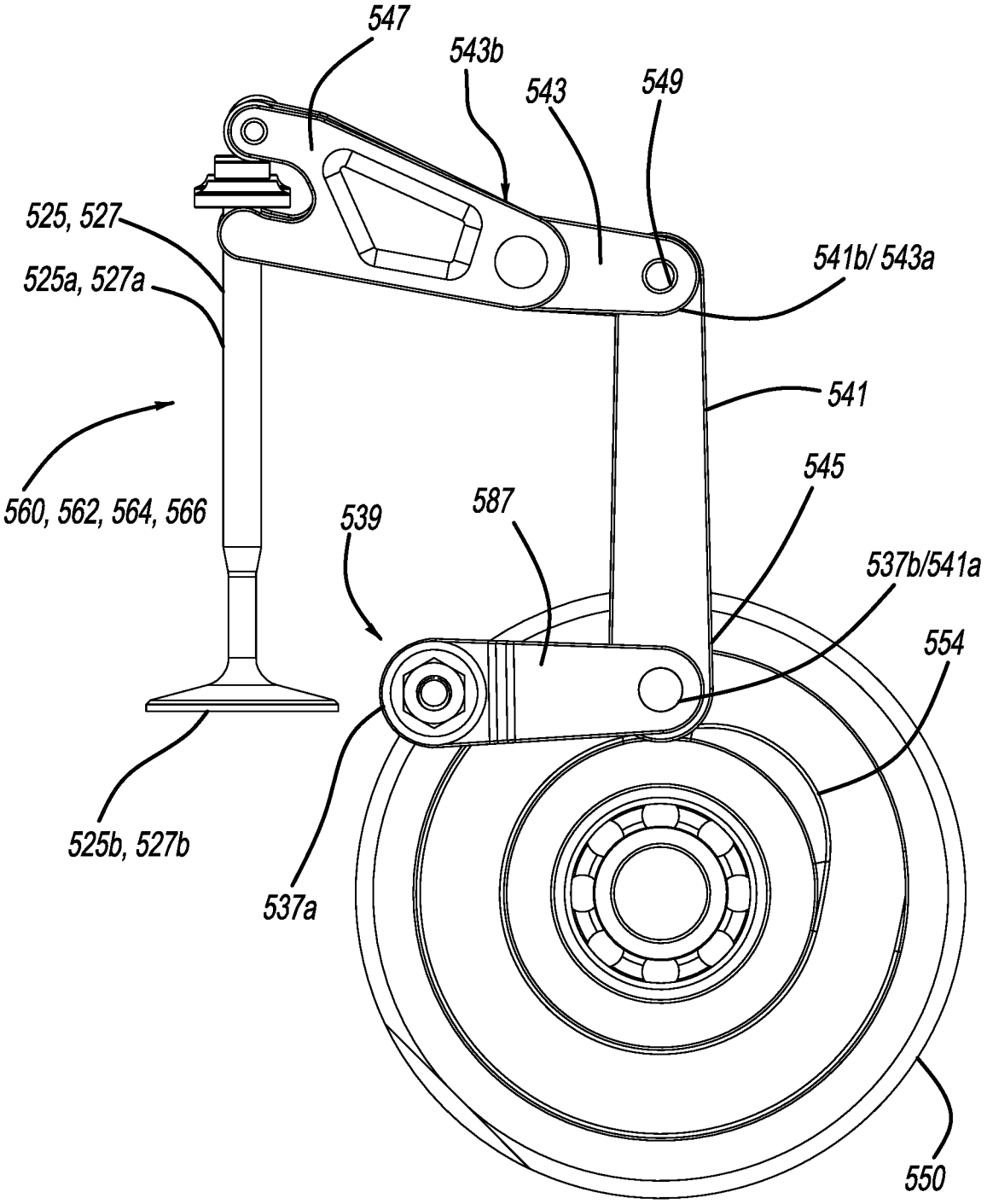
FIG. 14 is a side view of a preferred Desmodromic valve assembly in operative communication with the cam ring, in accordance with the present invention.
Figure 15:
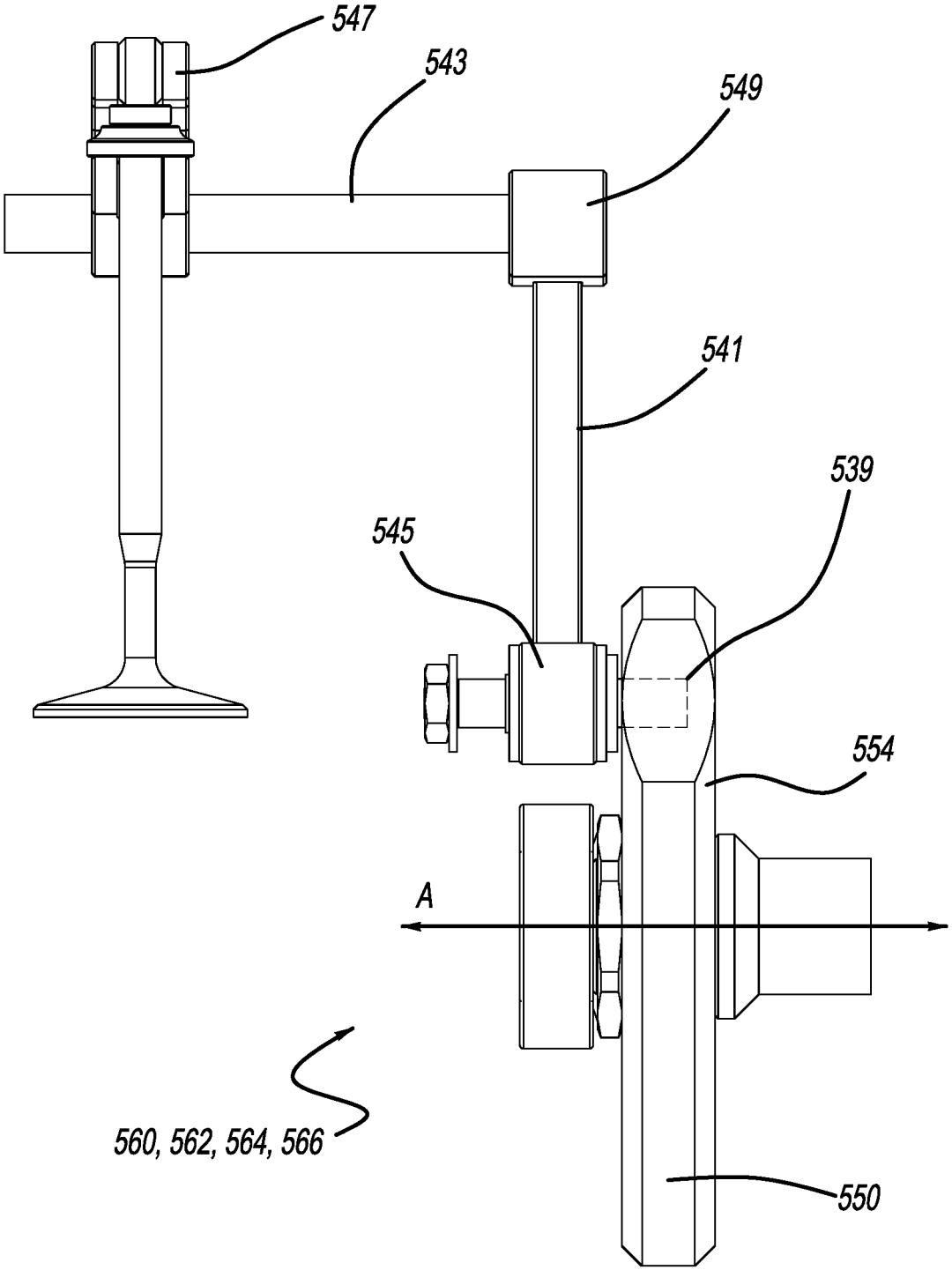
FIG. 15 is a rear view of the cam ring of the assembly of FIG. 14.

The valve assemblies 560, 562, 564, 566 of the present invention may be any known or applicable valve assembly. A preferred valve assembly is formed in a known manner as a Desmodromic valve assembly. As known in the art, a Desmodromic valve is a reciprocating engine valve that is positively closed by a cam and leverage system, rather than by a more conventional spring. Each Desmodromic valve assembly contains a plurality of connected armatures for actuation of an associated valve responsive to the cam groove of the cam disc. The width and the depth of the cam groove 554 may be tailored to affect the desired timing of the respective valve actuation. Alternatively, the cam disc 550-552' might itself be spooled inwardly toward the gear drive 512 or outwardly away from the gear drive 512 by known drivers, thereby obviating the need to vary the depth of the cam groove 554 to accomplish the same function. A first armature 537 of the valve assembly contains a cam follower 539 that traces the cam groove 554 as the cam disc 550-552' rotates responsive to the associated gear 512*c* or 512*d*. In general, the mechanism by which a camming surface engages a follower arm to actuate a rocker arm so as to open and close an associated poppet valve is known in the art, and the similar operation of the particular valve embodiments shown in the FIGURES to control flow into and out of the cylinder combustion chamber 521 are described herein. Referring to FIGS. 14 and 15, a spherical cam roller 539 is attached to a first end 537*a* of the first armature 537, and slidably engages the cam groove 554 as the cam disc 550, 550', 552, 552' (e.g. 550-552') rotates. A second armature 541 is pivotally engaged with a second end 537*b* of the first armature 537 at a first pivotable connection 545, whereby a ball joint, pin, or other pivoting means connects the second end 537*b* of the first armature 537 with a first end 541*a* of the second armature 541. The second armature 541 is substantially orthogonal or perpendicular to the first armature 537 during operation of the cam disc 550-552'. A third armature 543 is pivotally engaged with a second end 541*b* of the second armature 541 at a second pivotable connection 549, whereby a second ball joint, pin, or other pivoting means connects the second end 541*b* of the second armature 541 with a first end 543*a* of a third armature 543. The third armature 543 is substantially orthogonal or perpendicular to the second armature 541. A valve actuator 547 is fixed to a second end 543*b* of the third armature 543 and opens and closes the associated valve as the cam disc 550-552' rotates to provide a bias or pressure at the valve actuator end 543*b* of the third armature 543. Stated another way, as the cam disc 550/550' rotates from the base portions 517 through the projecting portions 519, a resultant torque or bias on the plurality of armatures cyclically affectssp leverage on the rocker arm 547 thereby affecting the opening and closing of the associated valve 525/527.

A conventional poppet valve 525/527, has a conventional valve stem 525*a*/527*a* having a plug 525*b*/527*b* mounted to a first end 525*c*/527*c* of the stem, whereby the first end of the stem is fixed to the rocker arm or valve actuator 547. A valve seat 525*d*/527*d* is contained in the cylinder opening 510*a*/510*b* and functions as a valve guide and seat during operation of the four-stroke cycle. As indicated in the FIGURES, the valve 525/527 opens and closes as it vertically moves within the valve guide or valve seat 525*d*/527*d*. A corresponding detent or depression 520*a*/530*a*, collectively formed in the geometry of the dual-piston 520/530 interface at top dead center, provides a clearance for operation of the valve within the cylinder.

The base and projecting portions 517, 519 of the cam 550-552' are positioned and secured with respect to each other so as to form a continuous camming surface or profile 556 engageable by an associated actuatable valve element (such as a cam follower 539 as described above) as the cam disc 550-552' rotates. Thus, the actuatable valve element or cam follower 539 will alternately engage the cam base portion(s) 517 and any projecting portion(s) 519 as the cam 550-552' rotates.

In the embodiment shown in FIGS. 1-9, the cam discs 550-552' or surfaces are arranged so as to reside on at least one side of the gears 512*c* and 512*d*. The projecting portions 519 of the cam disc 550-552' extend radially outwardly to a greater degree than the base portions 517 of the cam disc 550, 552. Thus, a portion of an actuatable valve element 539 engaging a base portion 517 of a cam will be forced radially outwardly when a cam projecting portion 519 rotates so as to engage the actuatable valve portion.

Figure 10:
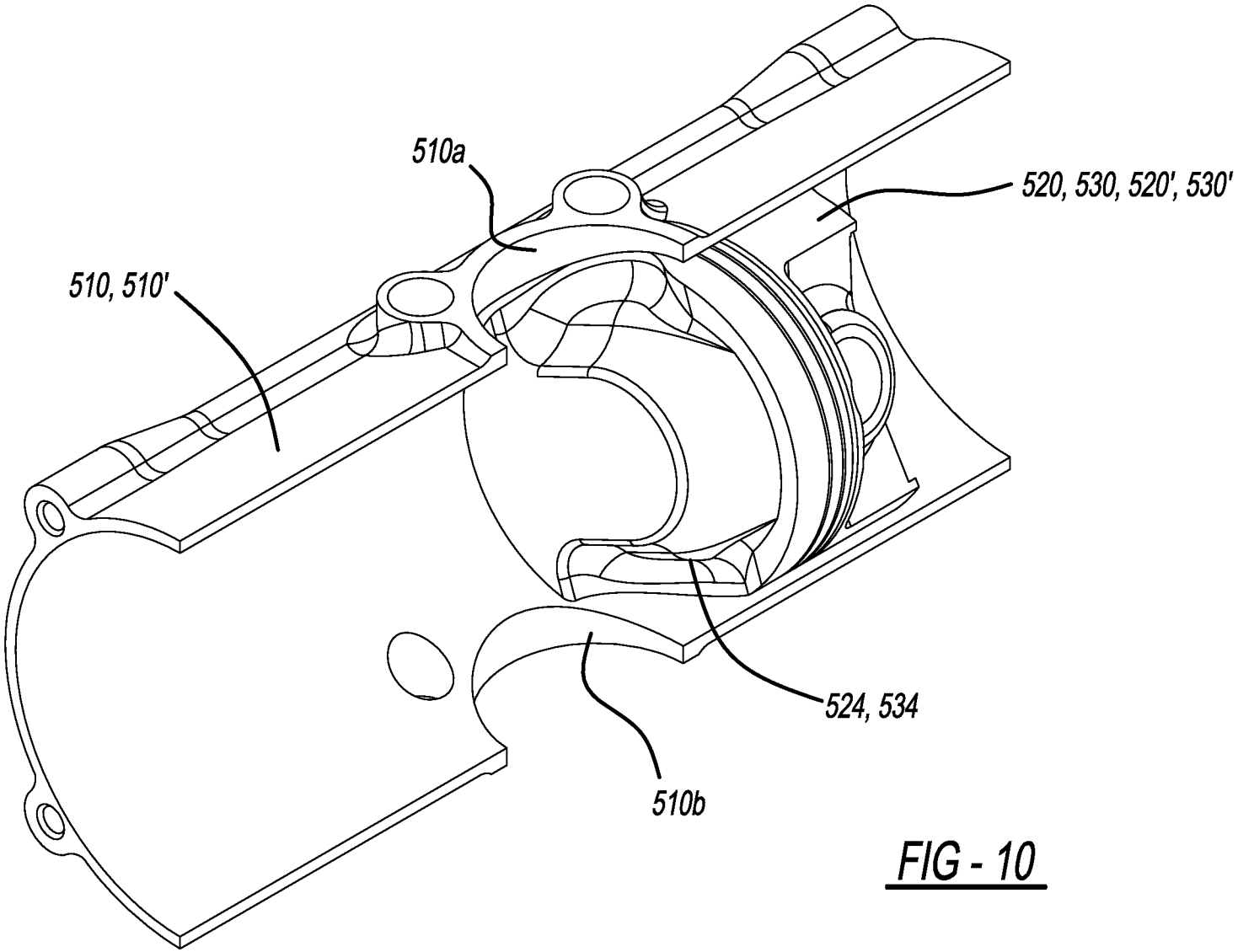
FIG. 10 is a cut-out view of a piston face of FIG. 9, illustrating the piston face at top dead center within the cylinder.

Referring to FIG. 10, if desired, the size of the cylinder opening 510*a*, 510*b* leading into (or from) the combustion chamber 521 may be controlled by suitably dimensioning the radial distances of an associated portion of the cam profile with regard to the radial distances of the base portions 517 and the radial distances of the projecting portions 519 of the cam disc 550, 552. The amount of time or proportion of the engine cycle during which the valve is either open or closed may also be controlled by appropriately specifying the arc length occupied by the base portions 517 and projecting portions 519 of the cam profile 556. Transition of the valve assembly from a first state to a second state may be provided by a ramp or slope (or profile) 519*a* formed in part of the projecting portion 519.

FIG. 8 illustrates an exemplary embodiment wherein the base portions 517 of the cam profiles 556 reside at substantially equal radial distances from an axis A extending through the center of the cam disc 550,552, and wherein the projecting portions 519 of the cam profiles 556 reside at ramped radial distances, that is radial distances gradually increasing and then gradually decreasing toward and relative to the substantially equivalent radial distances of the base portions 517. As seen in FIG. 8, the distances of the projecting portion profiles 519*a*, 556 from the rotational axis A of the cam disc 550-552' are greater than the distances of the base portion profiles 517*a*, 556 from the rotational axis A of the cam disc 550-552'. Thus, this embodiment provides two states (for example, "valve open" and "valve closed"), each state corresponding to a distance of one of the base portion profile or the projecting portion profile from the rotational axis A of the cam disc 550, 550', 552, 552', between which an associated valve assembly alternates during rotation of the cam 550-552'.

In other embodiments, any one of multiple intermediate states of the valve assembly may be achieved and maintained by providing cam projecting portions defining cam surfaces located at corresponding distances from the rotational axis A of the cam disc 550. All cam discs 550-552' essentially operate in the same manner. For example, in one embodiment, beginning at a point in the base projection, the intake valve 525 is opened as the exemplary cam disc 550 rotates 180 degrees from the beginning point, and the cam follower 539 cycle through greater radial distances as the disc 550 rotates through the projecting portions 519 of the disc, thereby defining the intake cycle of the four-stroke process. As the cam disc 550 continues to rotate, the intake valve 525 is closed as the cam disc 550 again approaches the base portions 517, and the compression cycle is conducted from about 181 degrees to 360 degrees of the rotation through the base portions 517 of the cam disc 550. As the cam disc 550 continues to rotate another 180 degrees for a total of 540 degrees, the expansion or combustion cycle is conducted, whereby both of the intake and exhaust valves 525, 527 are closed to seal the combustion chamber 521 during the expansion cycle. Finally, as the cam disc 550 rotates another 180 degrees for a total of 720 degrees of rotation, the exhaust cycle is completed whereby all exhaust gases exit the cylinder as they are shunted through the exhaust valve 527. Once the exhaust cycle is complete, the cam disc 550 then repeats the process to again rotate 720 degrees as the four-stroke process is repeated during the engine operation. In the embodiment shown in FIG. 8, a cam base portion surface 556 may be dimensioned to provide a closed state of the valve 525 or valve 527. In addition, a first projecting portion 519 having a camming surface 519*a* spaced a first radial distance D5 from the rotational axis A of the cam disc 550 when mounted on intermediate gear 512*c* (or 512*d*) may provide a "partially open" state of the valve 525 when engaged by an associated actuatable valve portion. Also, a camming surface 519*a*, 556 formed on projecting portion 519 (or on a separate projecting portion) and spaced a second radial distance D6 from the rotational axis A greater than the first distance D5 may provide a "fully open" state of the valve 525 when engaged by the actuatable valve portion. See FIG. 8.

In a particular embodiment, when the actuatable portion or cam follower 539 of the valve assembly 560, 562, 564, or 566 engages and slides along the base portion(s) 517 of the cam profile 556, the associated valve assembly is in a closed condition (i.e., the valve assembly prevents flow of air into (or exhaust gases from) the cylinder combustion chamber 521. Also, when the cam follower or actuatable portion 539 of the valve assembly engages and slides along the projecting portion(s) 519, the valve assembly is in an open or partially open condition (i.e., the valve assembly permits flow of air into (or exhaust gases from) the cylinder combustion chamber 521.

The camming discs or elements 550-552' may be in the form of rings or other structures attachable to the exterior surface of the gears 512*c* and 512*d*. In a particular embodiment, the base and projecting portions 517 and 519, respectively, of the camming elements or discs 550, 550', 552, or 552', are modular in construction so that these elements may be changed out to provide any of a variety of cam profiles. In addition, the projecting portions of a cam profile may be changed out independently of the base portions of the profile. These options enable greater flexibility in control of the valve sequencing, enabling correspondingly greater control of the engine cycle.

Base portion(s) 517 and projecting portion(s) 519 may be attached to the cam disc 550 (or any other of the cam discs) using any suitable method, thereby creating a first arcuate region defined by the base portions 517 and a second arcuate region that is defined by ramped radial lengths of the projecting portions 519 as shown in FIG. 8.

Because the projecting portion 519 actuating the valve 525 can be relocated so as to engage the valve 525 either sooner or later during rotation of the cam disc 550 (and, therefore, sooner or later in the engine cycle), the associated valve 525 may be opened or closed either sooner or later during the engine cycle. Thus, in one embodiment, the detachability and modularity of the camming elements 517 and 519 of the cam disc 550 may enable fine tuning of the engine cycle by adjustment of the valve actuation timing.

Alternatively, the cam discs 550, 550', 552, 552' may be formed as a machined monolithic disc wherein the respective cam groove 554 defined by the base portions 517 and projecting portions 519 may be altered by changing the entire cam disc 550 for one that has been machined to change the variability of the radial distances of the projecting portions 519, and perhaps the arcuate length of the base portions 517 and the projecting portions 519. The change in the design of the cam groove 554 therefore facilitates actuation of the valve 525 (or the valve 527) at a different point in the engine cycle and/or for a different length of time.

A follower 539 operatively connected to an associated valve 525 and valve 527 engages and follows the camming surfaces 556 of the disc 550 as the disc rotates. When the follower 539 reaches and engages a plurality of the ramped camming surface 519*a* residing in the projecting portions 519 of the cam disc 550 (as shown in FIG. 8), the follower 539 is raised as described elsewhere herein, causing the follower 539 or a pushrod coupled to the follower 539 to rotate a rocker arm 547, resulting in the opening of the valve 525 or 527, depending on where the follower 539 engages the cam groove 554. Accordingly, in this embodiment, one valve assembly 532 operable by cam disc 550 may be positioned below the engine to actuate a valve mechanism positioned beneath the engine, while another valve assembly operable by cam disc 550' is positioned above the engine to actuate a valve mechanism 534 positioned above the engine.

Figure 5:
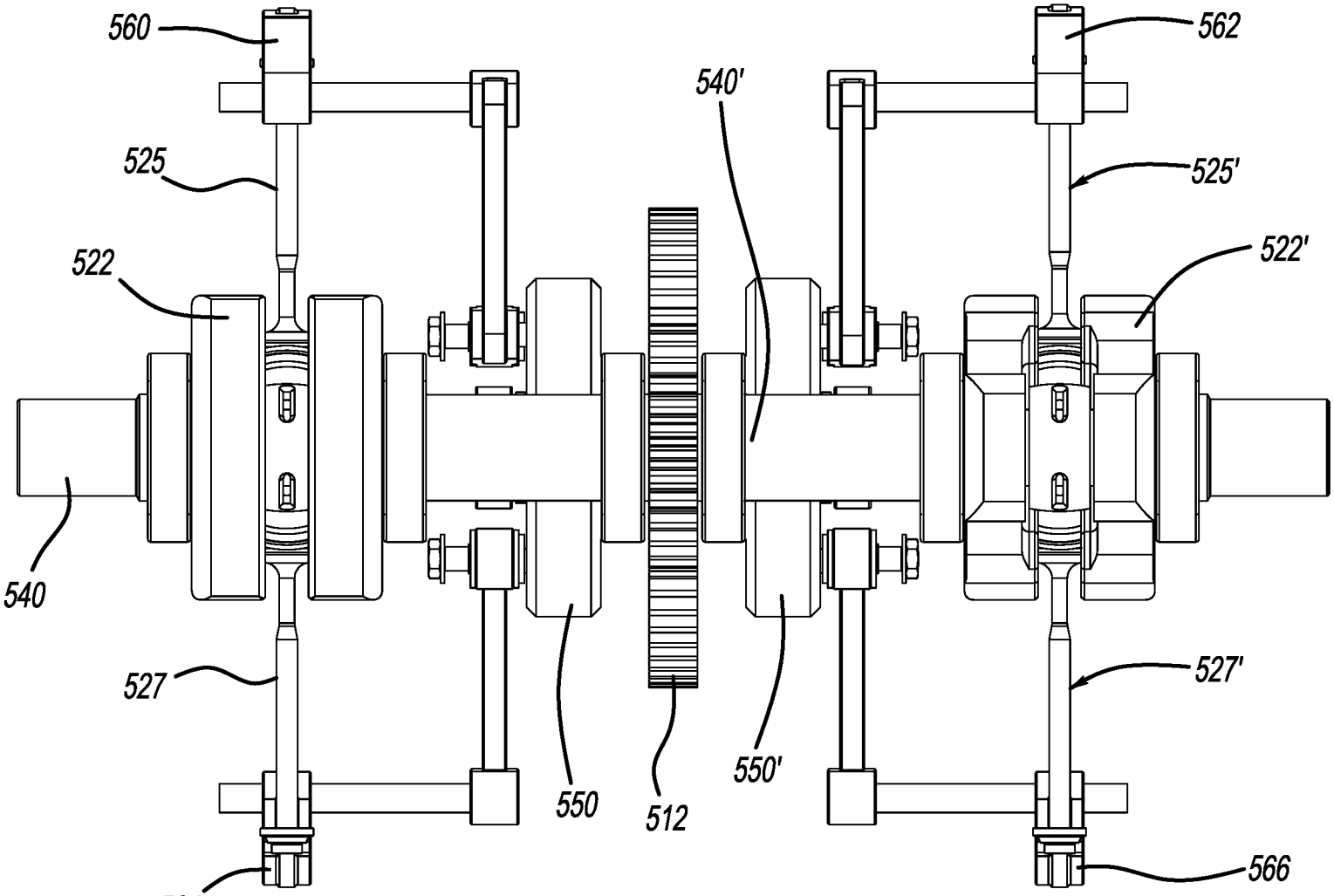
FIG. 5 is a rear view of the exemplary embodiment of FIG. 1, illustrating exemplary valve mechanisms.

Referring to FIG. 5, in another embodiment, a cam disc 550 as previously described is mounted coaxially with gear 512*c* so as to rotate in conjunction with the gear 512*c*. Each cam disc and associated inner gear 512*c* or 512*d*, are operably oriented in this same configuration. In addition, the follower and/or other portions of the valve mechanism are oriented with respect to the cylinder housing such that the valve opens and closes as the follower 539 engages and follows the camming surfaces 556, as previously described.

FIGS. 1-5, illustrate a first embodiment of the present invention, and exemplify the internal components of the cylinder and crank shaft housings (not shown in these FIGURES). A plurality of drive gears 512*a*, 512*b*, 512*c*, 512*d*, constitutes an engine drive train 512. As shown, the teeth 512*e* of each respective gear is enmeshed, interlocked, or engaged with at least one of the juxtaposed and linearly-oriented drive gears 512*a*-512*d*.

A first crank shaft 540 is coaxially fixed to the first gear 512*a*, through medial portion 512*a*' of the first gear 512*a*. A first rod 522 is also coaxially fixed about a first end of the first crank shaft 540, and fixed to a first piston 520, for cycling the first piston 520 within a first cylinder 510. A second rod 522' is fixed about a second end of the first crank shaft 540, and fixed to a second piston 522', for cycling the second piston 522' within a second cylinder 510'. A third gear 512*c* is rotatably engaged with the first drive gear 512*a*. A first cam disc 550 and a second cam disc 550' are rotatably, coaxially, and concentrically oriented with, or fixed to, the third gear 512*c*, each cam disc about an opposite side of the gear 512*c*.

Figure 3:
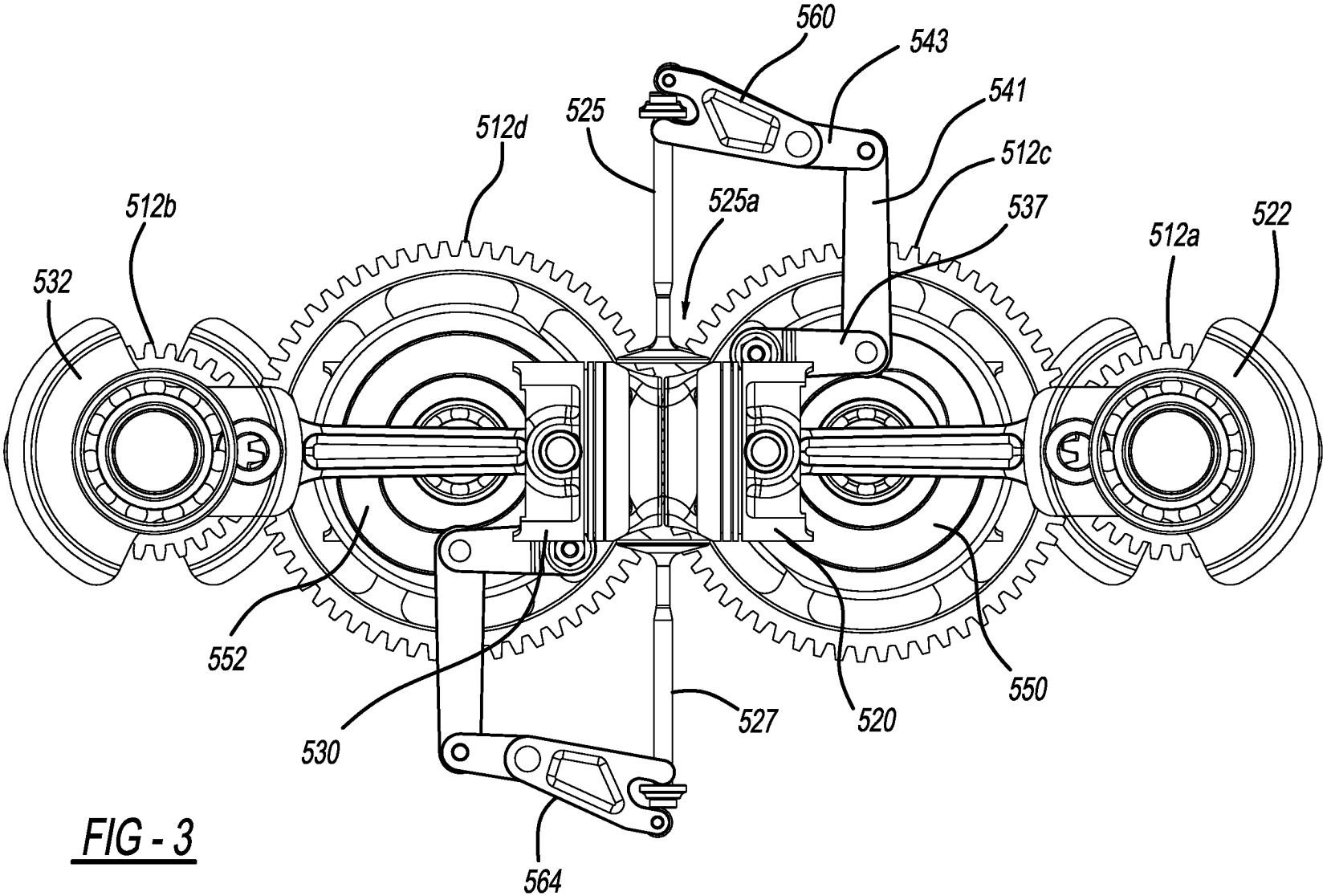
FIG. 3 is a side view of the exemplary embodiment of FIG. 1.
Figure 4:
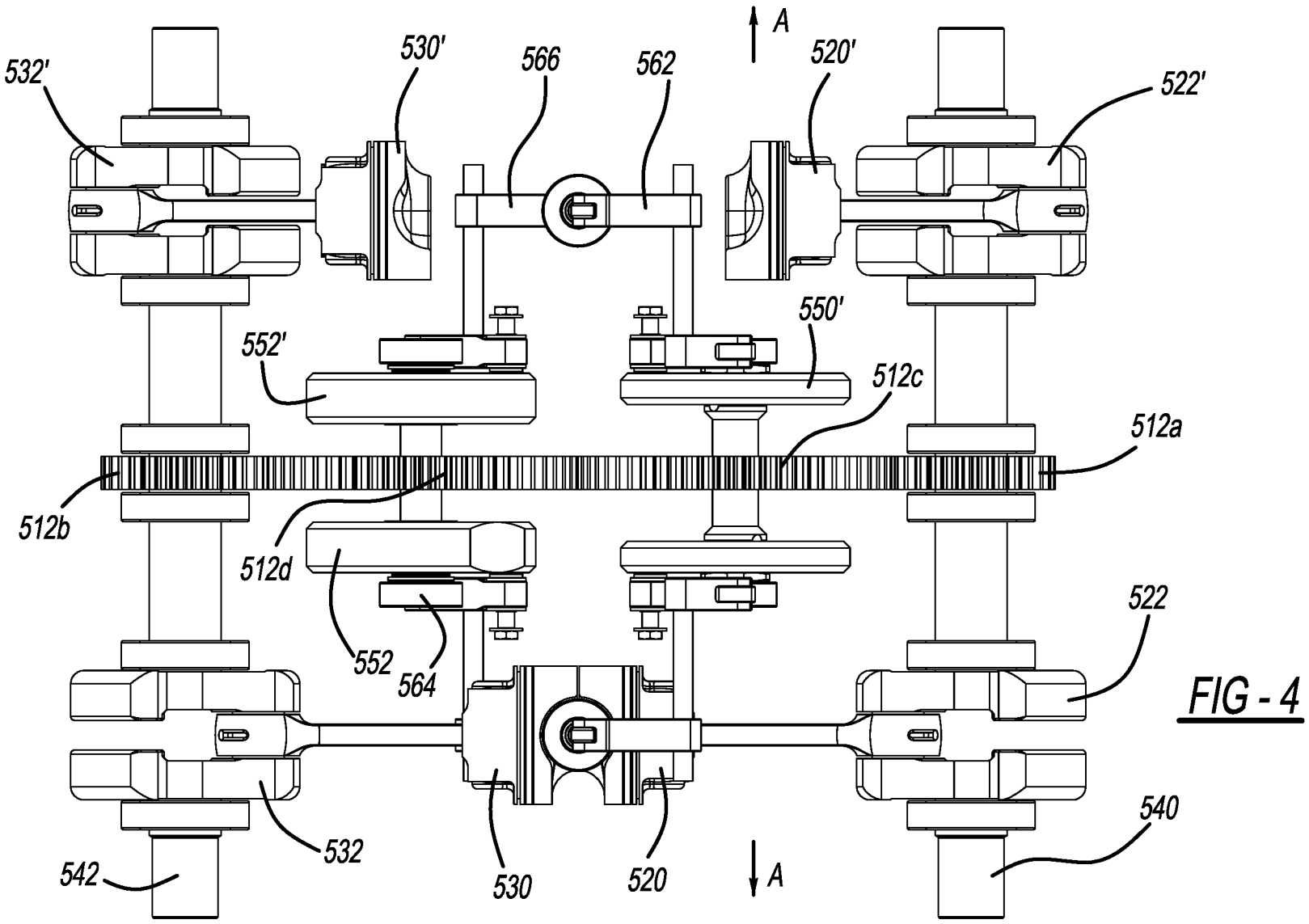
FIG. 4 is a top view of the exemplary embodiment of FIG. 1, again without cylinders.

As schematically shown in FIGS. 3-5, a first valve assembly 560 is fixed above the engine and operatively connected to the cam disc 550, for opening and closing of a first inlet valve 525 also operatively connected to the first valve assembly 560. A first valve seat 525*a* functions as a guide and a seat for the first valve 525 as the plurality of arms 537, 539, 541, and 543 of the first valve assembly 560 respond to the cam follower 539, as described above, to thereby actuate the first inlet valve 525 in conjunction with the cam profile 556 of the cam disc 550.

A second valve assembly 562 is fixed above the engine and is operatively connected to the cam disc 550', for opening and closing of a second inlet valve 525' (not shown) also operatively connected to the second valve assembly 562. A second valve seat 525*a*' (not shown) functions as a guide and a seat for the second inlet valve 525' as the plurality of arms 537, 539, 541, and 543 of the second valve assembly 530 respond to the cam follower 539, as described above, to thereby actuate the second inlet valve 525' in conjunction with the cam profile 556 of the cam disc 550'.

A second crank shaft 542 is coaxially fixed to the second gear 512*b*, through medial portion 512*b*' of the second gear 512*b*. A third rod 532 is also coaxially fixed about a first end of the second crank shaft 542, and fixed to a first piston 530, for cycling the first piston 530 within a first cylinder 510. A fourth rod 532' is fixed about a second end of the second crank shaft 542, and fixed to a fourth piston 530', for cycling the fourth piston 530' within the second cylinder 510'. A fourth gear or synchro gear 512*d* is rotatably engaged with the first drive gear 512*b* and the third drive gear 512*c*. A third cam disc 552 and a fourth cam disc 552' are rotatably, coaxially, and concentrically oriented with, or fixed to, the fourth gear 512*d*, each cam disc fixed to an opposite side of the gear 512*d*. See FIG. 4, for example.

A third valve assembly 564 is positioned beneath the engine 500 and operatively connected to the cam disc 552, for opening and closing of a first exhaust valve 527 also operatively connected to the third valve assembly 564. A third valve seat 525*c* (not shown) functions as a guide and a seat for the first exhaust valve 527 as the plurality of arms 537, 539, 541, and 543 of the third valve assembly 564 respond to the cam follower 539, as described above, to thereby actuate the first exhaust valve 527*a* in conjunction with the cam profile 556 of the cam disc 552.

A fourth valve assembly 566 is operatively connected to the cam disc 552', for opening and closing of a second exhaust valve 527' also operatively connected to the fourth valve assembly 534. A fourth valve seat 527*a*' (not shown) functions as a guide and a seat for the second exhaust valve 527' as the plurality of arms 537, 539, 541, and 543 of the fourth valve assembly 566 respond to the cam follower 539, as described above, to thereby actuate the second exhaust valve 527' in conjunction with the cam profile 556 of the cam disc 550'.

Figure 6:
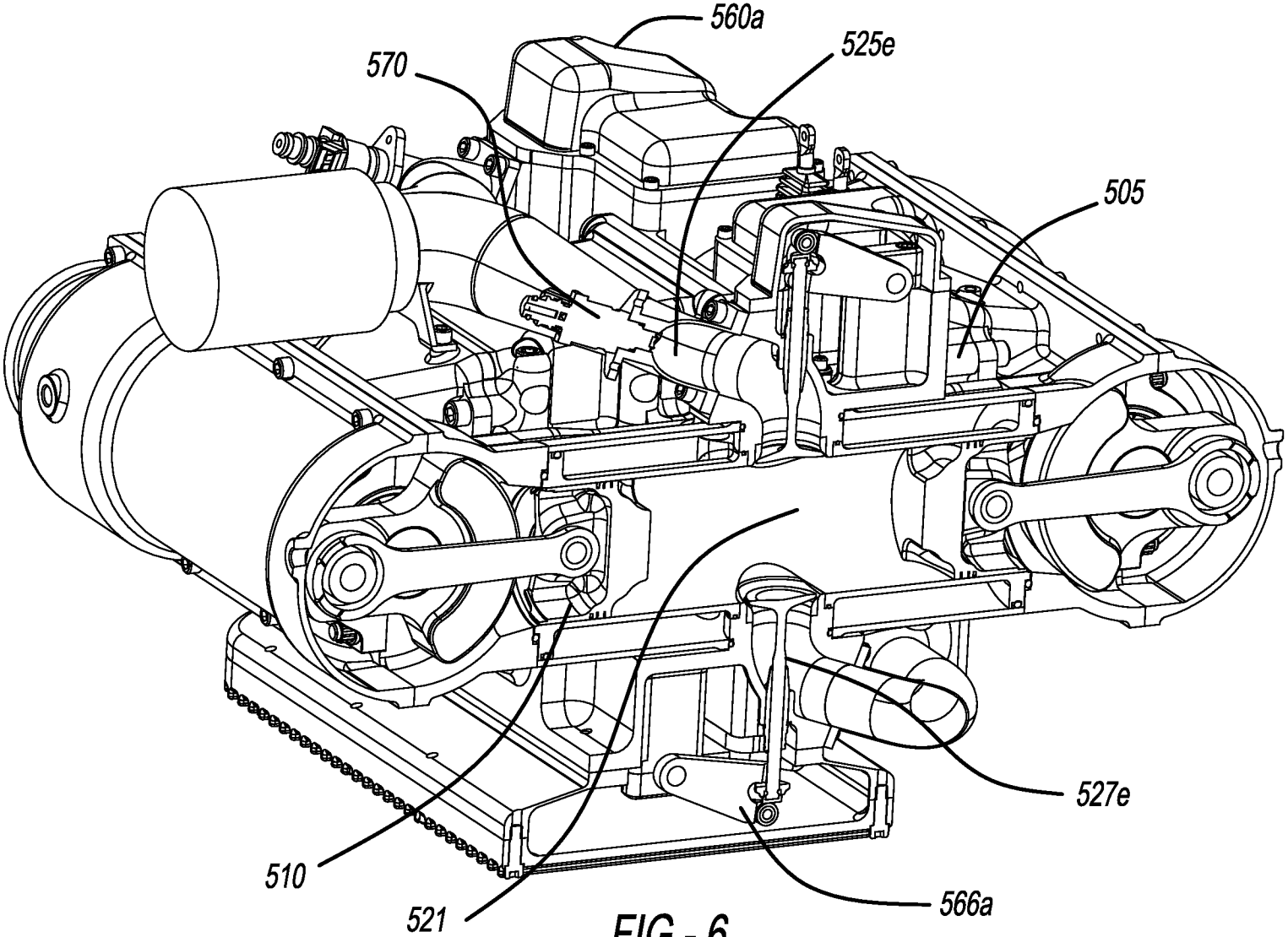
FIG. 6 is a cross-sectional view of an exemplary embodiment of the present invention, including the cylinders and engine housing, and further illustrating the internal structure of an exemplary engine.
Figure 7:
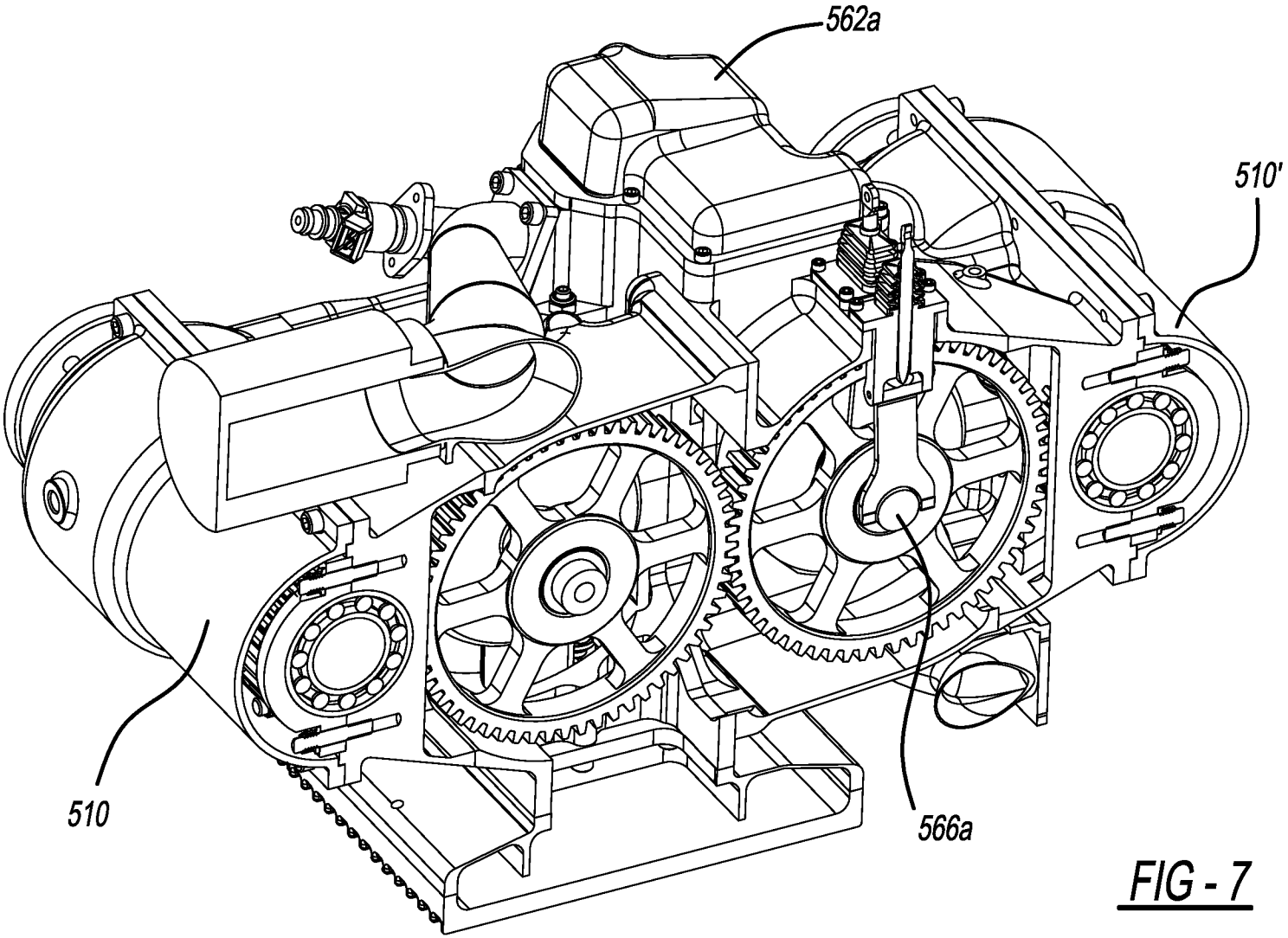
FIG. 7 is a partially cut-out perspective view of the embodiment of FIG. 6, wherein the engine housing and cylinders are also shown.
Figure 9:
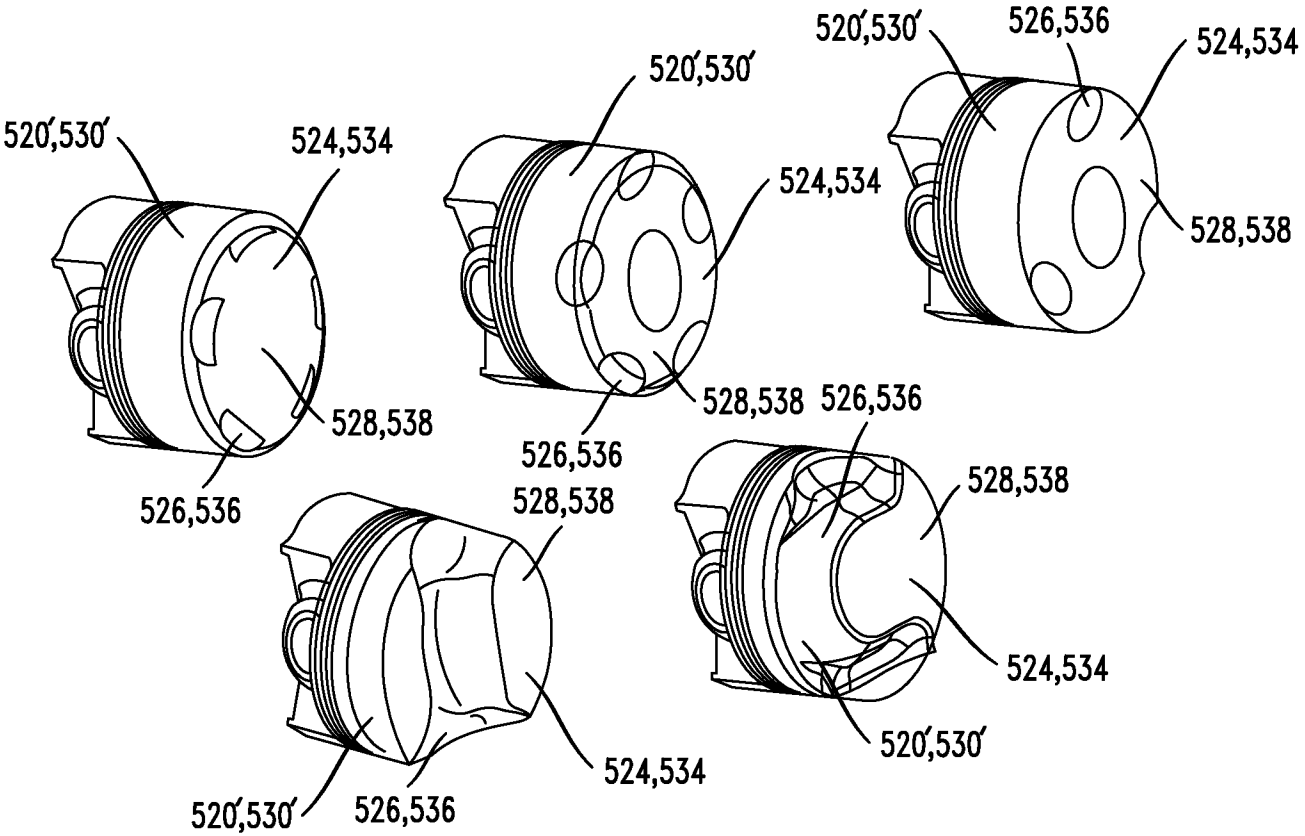
FIG. 9 is an exemplary group of piston faces that have toroidal character formed therein.

As shown in FIGS. 6 and 7, for example, each valve assembly has a corresponding valve housing or cover 560*a*, 562*a*, 564*a*, and 566*a*. Each set of pistons and rods has a corresponding cylinder 510, 510' for providing a combustion chamber and for providing a sealed environment for the four-stroke engine process. As shown in FIG. 6, each inlet valve 525 has an inlet conduit 525*e* for providing inlet air to the engine during the inlet cycle. Each exhaust valve 527 has an exhaust conduit 527*e* for removing the exhaust gases from the cylinders during the exhaust cycle. Each cylinder 510, 510' has a spark plug that communicates with a central combustion chamber 521 formed between the piston caps 524,534 or interfaces when each of the pair of opposed pistons are at Top Dead Center. As shown in FIGS. 9-10, each piston cap 524,534 of the pistons 520, 530, 520', and 530' may include a corresponding piston face 528, 538 and a corresponding annular region 526, 536. The corresponding annular region 526, 536 may be varied in shape to provide a desired geometry of the combustion chamber 521. The annular regions 526, 536 of the pistons 520, 530, 520', and 530' are located on a predetermined portion of a periphery of a corresponding piston cap of the piston caps 524 and 534 of the pistons 520, 530, 520', and 530'. The predetermined portion of the corresponding piston may be less than an entire periphery. It has been found that providing a large central area of combustion in the combustion chamber 521 provides for more efficient combustion and more efficient communication with the spark plug initiator 570. The spark plug initiator 570 may be partially contained with each combustion chamber 521.

Figure 11A:
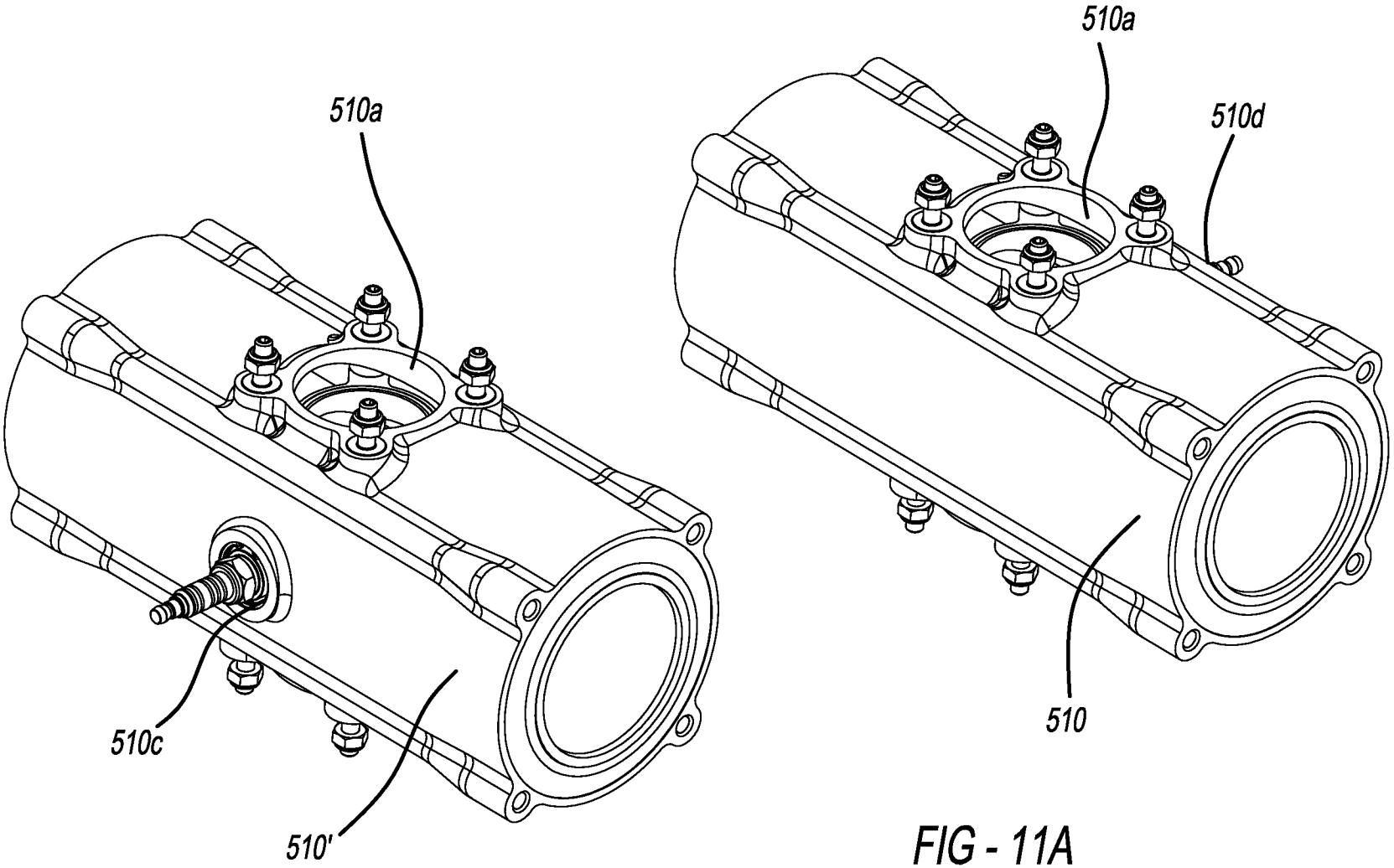
FIG. 11A is a perspective view of exemplary cylinders in accordance with the present invention.
Figure 11B:
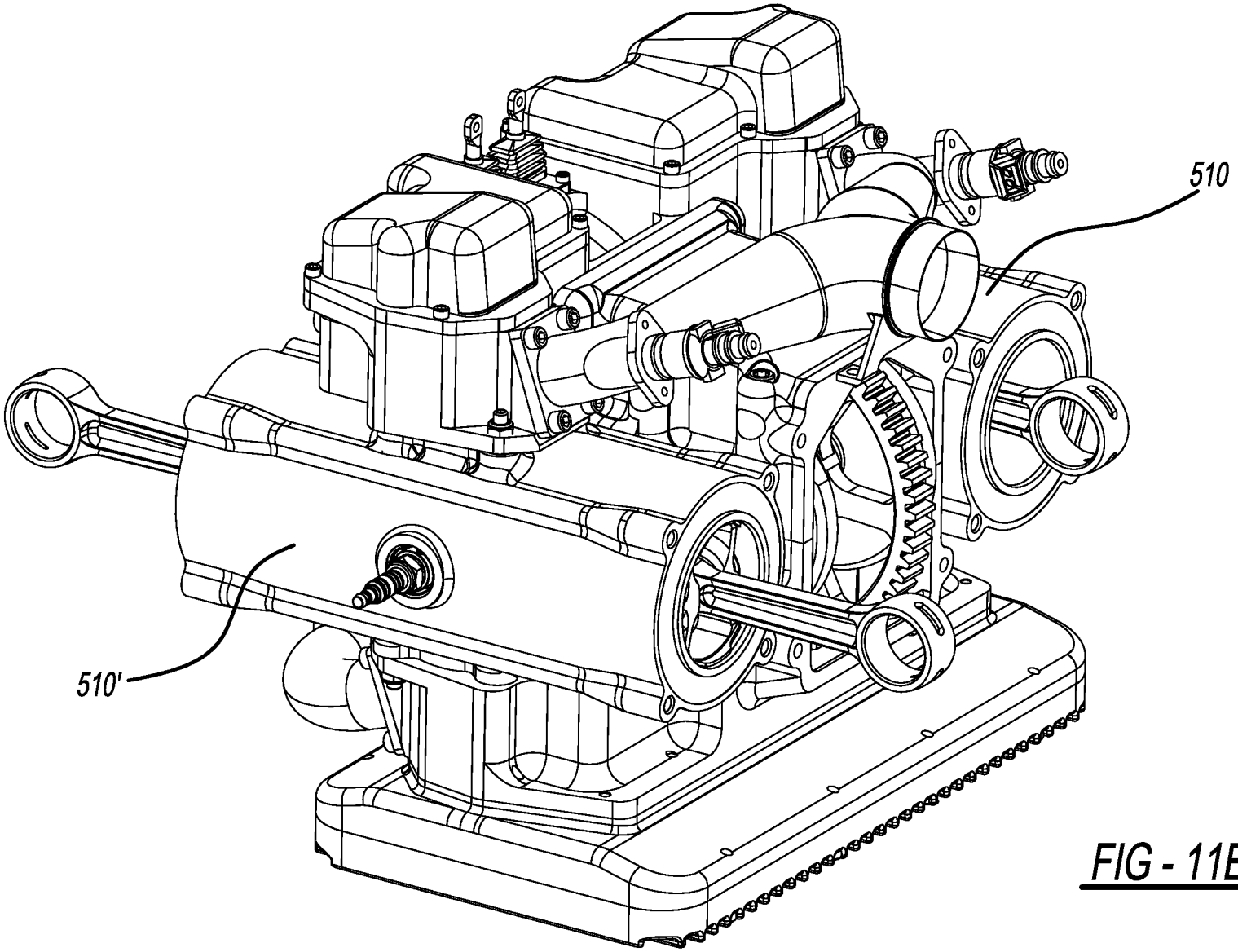
FIG. 11B is a perspective view of the exemplary cylinders of FIG. 11A positioned within an exemplary engine housing, and interfacing with a schematic view of valve assemblies, in accordance with the present invention.
Figure 12:
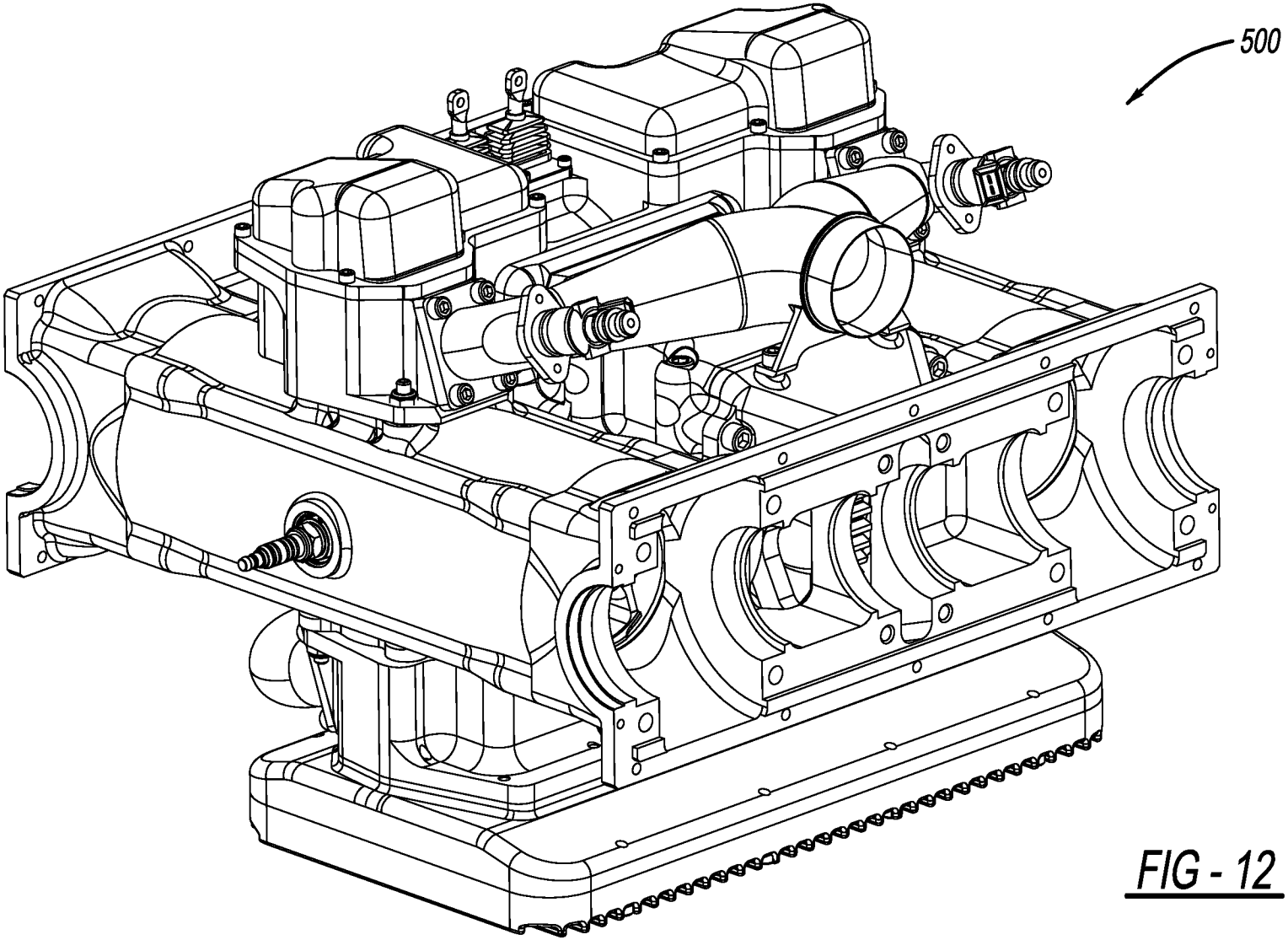
FIG. 12 is a perspective view of the engine housing of FIG. 11B, also containing an open crank shaft housing on either side of the engine housing.
Figure 13:
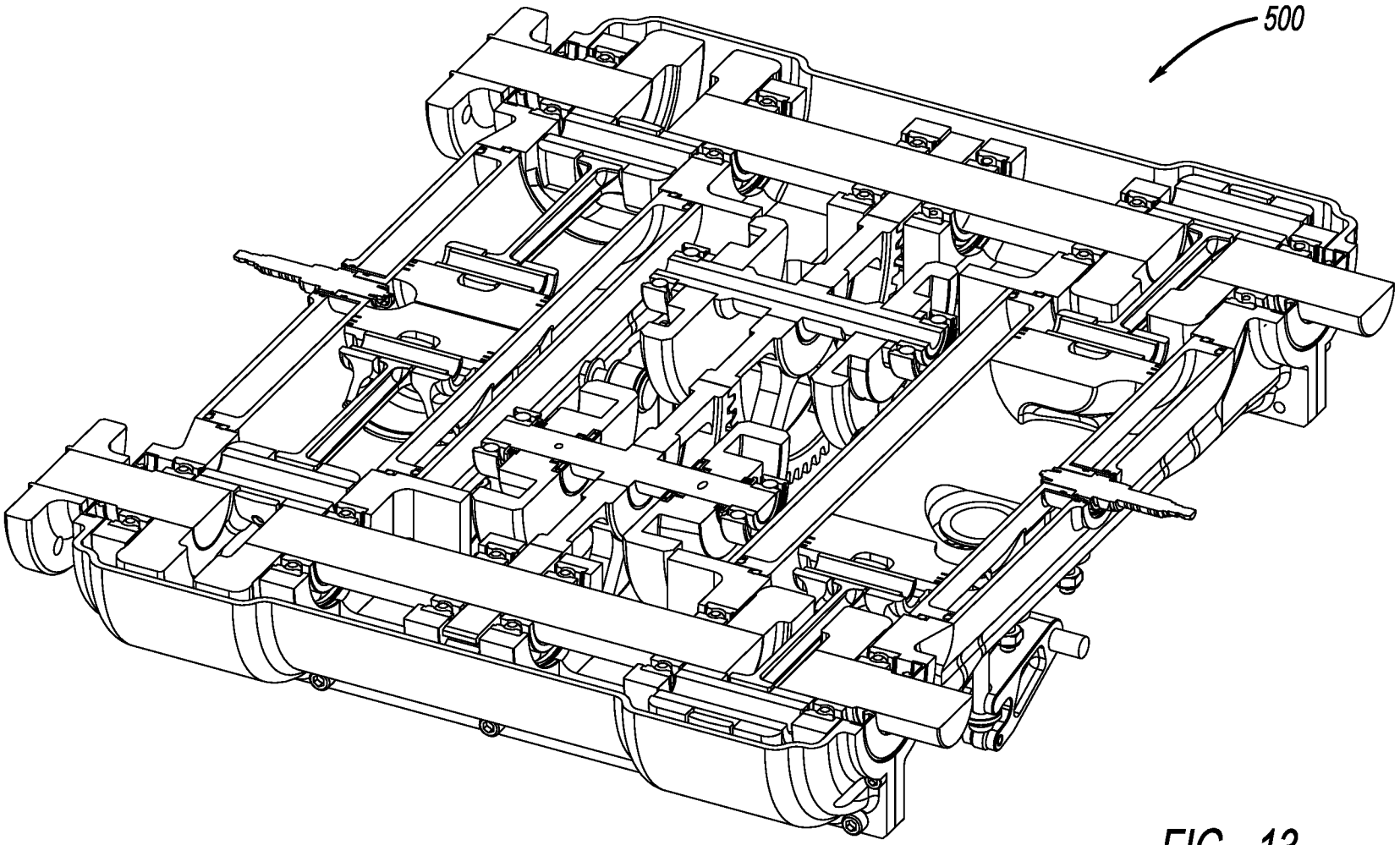
FIG. 13 is a perspective view of an open engine housing similar to FIG. 12, wherein the crank shaft and piston assemblies are shown in operative communication.

Other housing components of the engine 500 are illustrated in FIGS. 11A-13. FIG. 11A illustrates the cylinders 510, 510' containing cylinder openings 510*a* and 510*b*, and spark plug openings 510*c* and 510*d*. Spark plugs 510*c*1 and 510*d*1 are contained within the spark plug openings 510*c* and 510*d*, respectively. FIG. 11B illustrates the cylinders 510, 510' for housing the pistons, and, the valve housings 560*a*, 562*a*, 564*a*, 566*a*. FIG. 12 further illustrates the crank shaft housing components whereby a first half (or first half of a clam shell) of the first crank shaft housing of the first crank shaft is shown, and, a first half of the second crank shaft housing of the second crank shaft is shown. FIG. 13 illustrates a bottom half of the crank shaft housings for both the first and the second crank shafts, thereby sealing in the operative oil or lubricant for each crank shaft. FIGS. 14 and 15 provide a perspective view and a side view of the Desmodromic valve assembly, in accordance with the present invention. As shown in FIGS. 14 and 15, the respective valve assembly and cam disc are shown in operative communication with each other. If desired, an overall engine housing (505) as shown in FIG. 6 may be provided to cover the engine components.

Figure 16:
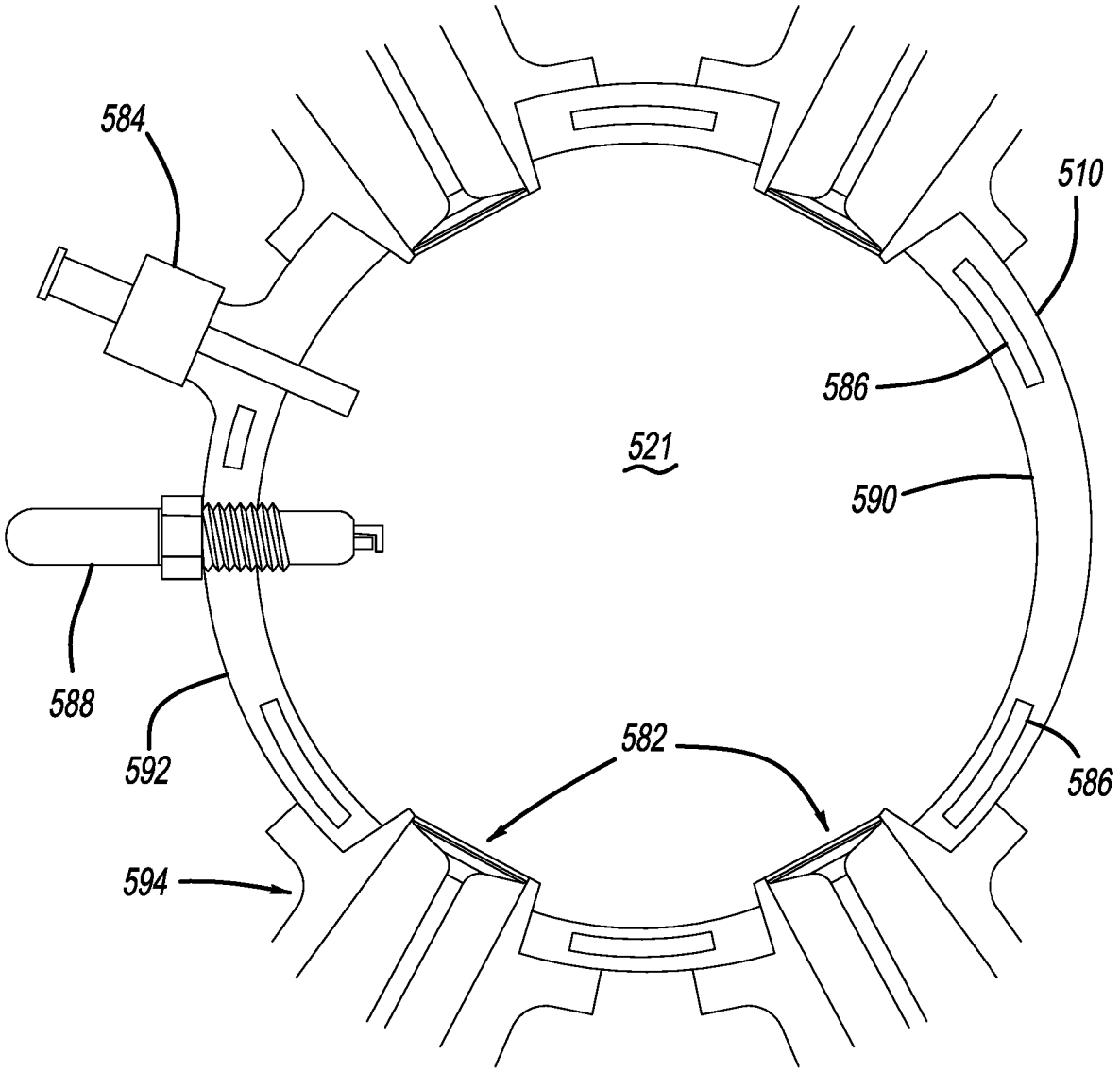
FIG. 16 is a cross-sectional view of an exemplary combustion chamber in accordance with the present invention.

FIG. 16 schematically illustrates another embodiment of the present invention whereby a pair of intake valves 580 and a pair of exhaust valves 582 are actuated by corresponding valve assemblies (not shown). A fuel injector 584 and a coolant jacket 586 are also exemplified in FIG. 16 whereby the cylinder 510 is cooled by a suitable coolant as known in the art. A spark plug 588 is centrally located to efficiently initiate the combustion process, in accordance with the present invention. An inner sleeve 590 and an outer sleeve 592 define the coolant jacket 586. A plenum 594 is defined about the exhaust valve 582.

Figure 17:
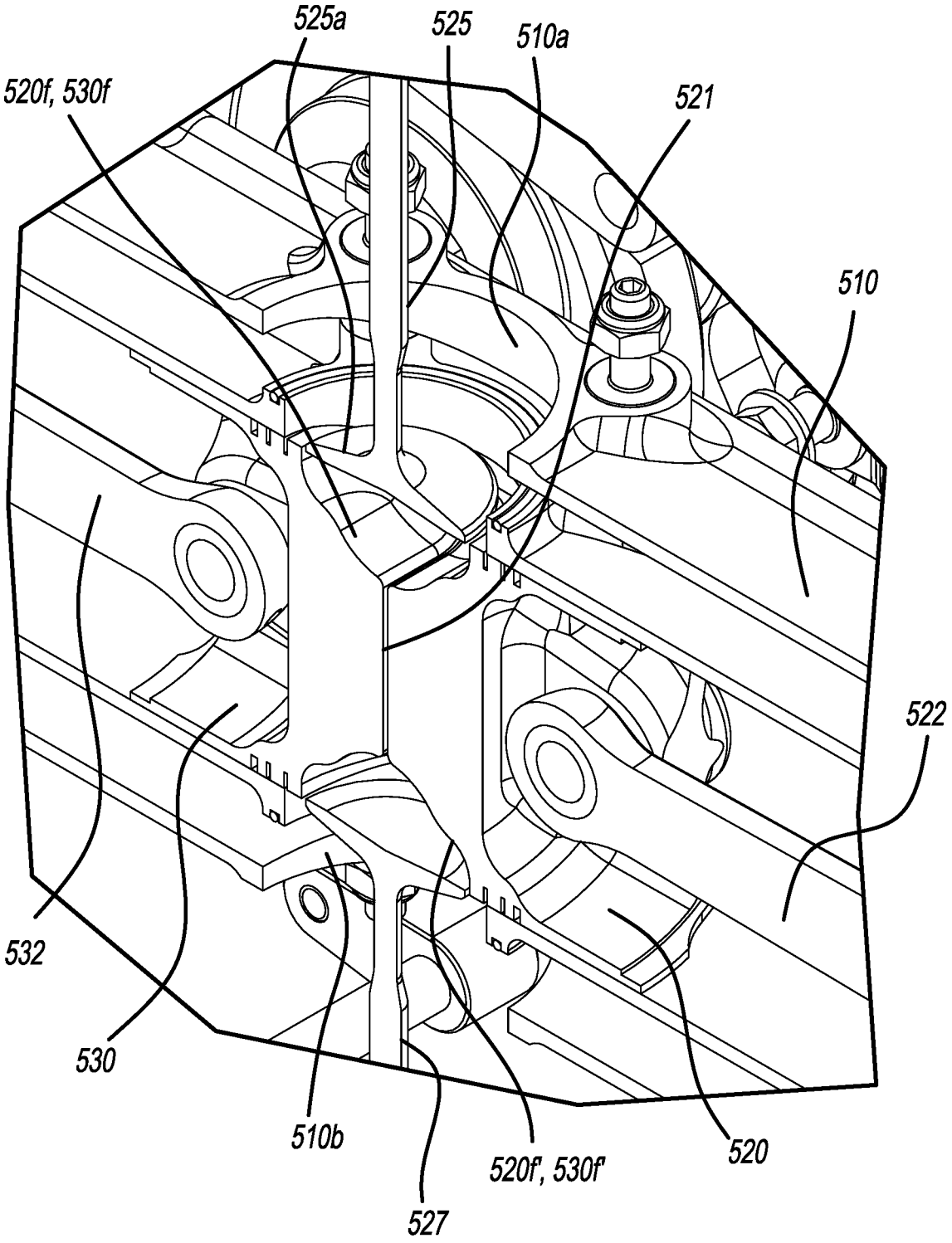
FIG. 17 is a cut-out view of two pistons at top dead center.

FIG. 17, in one embodiment, illustrates the interface of two opposed pistons whereby the piston cap interface at top dead center (TDC) forms a toroidal combustion chamber 521. The valves 525 and 527 are also seated within opposed detents or cavities 520*f*, 530*f*, 520*f*, 530*f* formed in the top and bottom of the pistons, that when combined work to seal the valve/piston interface during the four-stroke process, and during operation of the valves as they open and close.

In accordance with the present invention, FIG. 18 illustrates the novel relationship between the crank shaft gears 512*a* and 512*b*, and the synchro gears 512*c* and 512*d*. A 2:1 ratio is defined by the size of the synchro gears 512*c*/512*d* as compared to the size of the crank shaft gears 512*a*/512*b*. Stated another way, the synchro gears 512*c* and 512*d* have substantially equal diameters, as do the crank shaft gears 512*a* and 512*b*, whereby the synchro gears have twice the diameter as that of the crank shaft gears.

FIG. 19 illustrates the structural relationship between the opposed pistons 520 and 530, the gear train 512, and the cam discs 550 and 552.

It will be understood that the foregoing descriptions of various embodiments of the present invention is for illustrative purposes only. As such, the various structural and operational features herein disclosed are susceptible to a number of modifications, none of which departs from the scope of the present invention as defined in the appended claims.

What is claimed is:

1. A four-stroke opposed piston engine comprising:

a first cylinder containing a first piston, and, a second piston opposing the first piston;

a second cylinder containing a third piston, and, a fourth piston opposing the third piston;

a first piston face configured on the first piston, and, a second piston face configured on the second piston, said first and second pistons each—comprising respective first annular regions, said first annular regions defining a first combustion chamber that determines the compression and combustion efficiency within the chamber the when said first and second pistons are at top dead center;

a third piston face configured on the third piston, and, a fourth piston face configured on the fourth piston, said third and fourth pistons each comprising respective second annular regions, said second annular regions defining a second combustion chamber that determines the compression and combustion efficiency of the second chamber when said third and fourth pistons are at top dead center;

a first crank shaft operably communicating with said first and third pistons; and a second crank shaft operably communicating with said second and fourth pistons;

a drive train operably communicating with said first and second crank shafts and comprising a first crank shaft gear connected to said first crank shaft, a second crank shaft gear connected to said second crank shaft, a first synchro gear rotatably communicating with said first crank shaft gear, and a second synchro gear rotatably communicating with said second crank shaft gear, wherein (a) said first synchro gear, said first and second crank shaft gears are equal in diameter (b) said first and second synchro gears are equal in diameter, and (c) the diameter of said first and second synchro clears is twice the diameter of said first and second crank shaft gears, and wherein each combustion chamber of said first annular regions and said second annular regions, respectively, comprise a plurality of detents or depressions to receive operating valves at top dead center to allow for proper intake and evacuation of gases from a respective cylinder.

2. The engine of claim 1 wherein said first, second, third, and/or fourth piston faces are toroidal in shape.

3. The engine of claim 1 wherein said first, second, third, and/or fourth piston faces are flat-faced with side cavities.

4. The engine of claim 1 wherein said first, second, third, and/or fourth piston faces are full dome-faced.

5. The engine of claim 1 wherein said first, second, third, and/or fourth piston faces are half dome-faced.

6. The engine of claim 1 wherein said first, second, third, and/or fourth piston faces are radius dome-faced.

7. The engine of claim 1, further comprising at least one first spark plug partially within said first combustion chamber and at least one second spark plug partially within said second combustion chamber.

8. A four-stroke opposed piston engine comprising:

a first cylinder containing a first piston, and, a second piston opposing the first piston;

a second cylinder containing a third piston, and, a fourth piston opposing the third piston;

a first crank shaft operably communicating with said first and third pistons;

a second crank shaft operably communicating with said second and fourth pistons;

a drive train comprising (i) a first driver operably communicating with said first crank shaft, a second driver operably communicating with said second crank shaft, a third driver operably communicating with said first driver, and, a fourth driver communicating with said second driver, said third and fourth drivers each having a diameter twice that of said first and second drivers, (ii) a first crank shaft gear connected to said first crank shaft, a second crank shaft gear connected to said second crank shaft, a first synchro gear rotatably communicating with said first crank shaft clear, and a second synchro clear rotatably communicating with said second crank shaft gear and said first synchro gear, where (a) said first and second crank shaft gears are equal in diameter, and, (b) said first and second synchro gears are equal in diameter and (c) twice the diameter of the first and second crank shaft gears;

a first piston face located on the first piston, and, a second piston face located on the second piston, said first and second pistons each comprising respective first annular regions, said first annular regions defining a first combustion chamber wherein each combustion chamber of said first annular regions comprise a plurality of detents or depressions to receive operating valves at top dead center to allow for proper intake and evacuation of gases from a respective cylinder; and a third piston face located on the third piston, and, a fourth piston face located on the fourth piston, said third and fourth pistons each comprising respective second annular regions, said second annular regions defining a second combustion chamber wherein each combustion chamber of said second annular regions comprise a plurality of detents or depressions to receive operating valves at top dead center to allow for proper intake and evacuation of gases from a respective cylinder.

9. The engine of claim 8, further comprising at least one first spark plug partially within said first combustion chamber and at least one second spark plug partially within said second combustion chamber.

10. A four-stroke opposed piston engine comprising:

a plurality of cylinders, each cylinder containing a first piston and a second piston opposing the first piston;

a first piston face configured on each first piston, and, a second piston face configured on each second piston, each of said first and second pistons further comprising respective first annular regions, each first annular region defining a respective combustion chamber that determines the compression and combustion efficiency within the chamber when said respective first and second pistons are at top dead center;

a first crank shaft operably communicating with one or more of the first pistons;

a second crank shaft operably communicating with one or more of the second pistons; and a drive train comprising (i) a first driver operably communicating with said first crank shaft, a second driver operably communicating with said second crank shaft, a third driver operably communicating with said first driver, and, a fourth driver communicating with said second driver, said third and fourth drivers each having a diameter twice that of said first and second drivers, and (ii) a first crank shaft gear connected to said first crank shaft, a second crank shaft clear connected to said second crank shaft, a first synchro gear rotatably communicating with said first crank shaft gear, and a second synchro gear rotatably communicating with said second crank shaft gear, wherein (a) said first synchro gear, said first and second crank shaft pears are equal in diameter, and (b) said first and second synchro gears are equal in diameter and have a diameter twice that of said first and second crank shaft gears;

wherein each combustion chamber of each first annular region comprises a plurality of detents or depressions to receive operating valves at top dead center to allow for proper intake and evacuation of gases from a respective cylinder.

11. The engine of claim 10, further comprising at least one first spark plug partially within each respective combustion chamber.

* * * * *